US009235149B2

(12) United States Patent
Yoon et al.

(10) Patent No.: US 9,235,149 B2
(45) Date of Patent: Jan. 12, 2016

(54) TONER TO DEVELOP ELECTROSTATIC LATENT IMAGES

(71) Applicant: SAMSUNG Electronics Co., Ltd., Suwon-si, Gyeonggi-do (KR)

(72) Inventors: Se-young Yoon, Hwaseong-si (KR); Sung-jin Park, Suwon-si (KR); Seung-sik Woo, Hwaseong-si (KR); Hae-ree Joo, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/167,212

(22) Filed: Jan. 29, 2014

(65) Prior Publication Data

US 2014/0234766 A1 Aug. 21, 2014

(30) Foreign Application Priority Data

Feb. 18, 2013 (KR) ..... 10-2013-0016975

(51) Int. Cl.

| | |
|---|---|
| ***G03G 9/097*** | (2006.01) |
| ***G03G 9/08*** | (2006.01) |
| ***G03G 15/08*** | (2006.01) |
| ***G03G 21/18*** | (2006.01) |

(52) U.S. Cl.

CPC ..... *G03G 9/0821* (2013.01); *G03G 9/09708* (2013.01); *G03G 9/09716* (2013.01); *G03G 9/09725* (2013.01); *G03G 15/0865* (2013.01); *G03G 21/18* (2013.01)

(58) Field of Classification Search

CPC ..... G03G 9/08797; G03G 9/08755; G03G 9/0819; G03G 9/09708; G03G 9/09716; G03G 9/0925; G03G 9/09725

USPC ..... 430/108.1, 108.6, 108.7

See application file for complete search history.

(56) References Cited

U.S. PATENT DOCUMENTS

| | | | | |
|---|---|---|---|---|
| 6,197,466 | B1 | 3/2001 | Fields et al. | |
| 6,200,722 | B1 | 3/2001 | Fields et al. | |
| 7,306,667 | B2 | 12/2007 | Schumacher et al. | |
| 7,592,116 | B2 | 9/2009 | Suzuki et al. | |
| 2003/0129510 | A1 * | 7/2003 | Hagi et al. | 430/45 |

(Continued)

FOREIGN PATENT DOCUMENTS

| | | |
|---|---|---|
| EP | 1276014 | 1/2003 |
| EP | 2341395 | 7/2011 |

OTHER PUBLICATIONS

Extended European Search Report dated May 9, 2014 issued in EP Application No. 14151259.0.

*Primary Examiner* — Hoa V Le

(74) *Attorney, Agent, or Firm* — Staas & Halsey LLP

(57) ABSTRACT

A toner $T_1$ develops an electrostatic latent image, the toner $T_1$ having relieved charge-up characteristics, improved development characteristics, and improved transfer characteristics. The toner $T_1$ may ensure high charge stability against environmental condition changes, and an appropriate amount of charges at a high printing speed, may reduce background contamination on a photoreceptor, may prevent undesirable fusing onto a blade even after prolonged printing, and may have high transfer efficiency and high image uniformity. The toner $T_1$ may have effective flowability and transportability, and may have good storage stability, so as to be unlikely to cause blocking when stored for an extended time.

21 Claims, 8 Drawing Sheets

(56) References Cited

U.S. PATENT DOCUMENTS

2003/0186151 A1 10/2003 Nakayama et al.
2008/0261138 A1* 10/2008 Sukeno et al. ..... 430/108.6
2011/0020739 A1 1/2011 Nakamura et al.
2011/0151368 A1* 6/2011 Hong et al. ..... 430/108.8

* cited by examiner

TONER TO DEVELOP ELECTROSTATIC LATENT IMAGES

CROSS-REFERENCE TO RELATED APPLICATIONS

This application claims priority under 35 U.S.C. §119(a) from Korean Patent Application No. 10-2013-0016975, filed on Feb. 18, 2013, in the Korean Intellectual Property Office, the disclosure of which is incorporated herein in its entirety by reference.

BACKGROUND

1. Field

The present general inventive concept relates to an electrophotographic toner, and more particularly, to a toner to develop an electrostatic latent image.

2. Description of the Related Art

In general, electrophotographic imaging involves the following processes: uniformly charging a surface of an electrostatic latent image carrier, exposing the surface of the electrostatic latent image carrier to form an electrostatic latent image thereon, adhering toner to the electrostatic latent image to visualize the electrostatic latent image, transferring a resulting toner image onto a recording medium such as paper, cleaning the electrostatic latent image carrier to remove the toner remaining thereon, erasing charges from a surface of a photoreceptor to lower electrical characteristics, and fusing the toner image onto a recording medium by heat or pressure.

To obtain electrophotographic toner with appropriate characteristics, technologies of controlling the shape and surface of toner particles have become more important. The faster the printing speed of a printer, the more frequently the toner is subjected to a shearing force. Thus, stronger durability is required for toner. To realize a compact, environmentally-friendly printer, the amount of untransferred toner may be reduced. To this end, improvements in charge uniformity and transfer efficiency (transferability) of toner are advantageous. Improving charge stability, transfer efficiency, and cleaning ability of toner are effective in obtaining high-quality printed images.

To provide toner particles with high charge uniformity, high charge stability, high transfer efficiency, and high cleaning ability, surface characteristics of the toner need to be improved. One of the important factors affecting the surface characteristics of toner is an external additive adhered to surfaces of the toner particles. A primary function of the external additive is preventing adhesion of the toner particles to each other to maintain flowability of the toner particles. The external additive may also affect charge uniformity, charge stability, transfer efficiency and cleaning ability of the toner. For example, silica powder or titanium oxide powder is generally used as an external additive.

Conventional external additives are known to be ineffective in terms of charge uniformity. For example, fumed silica particles, as a most widely used external additive, have strong negative polarity. For this reason, excess charge-up may frequently occur with the use of toner that includes fumed silica as an external additive.

To prevent excessive frictional charging resulting from an excess charge-up due to the use of fumed silica, using titanium oxide particles as an external additive has been suggested. However, titanium oxide has a low electric resistance and an effective charge exchangeability, and may easily produce a reverse- or weak-charging toner. Accordingly, using titanium oxide as an external additive may lower charge uniformity of the toner.

Silica particles may be porous and have hydrophilic surfaces. When a toner including highly porous, highly hydrophilic silica particles as an external additive is used in a high-temperature, high-humidity environment, the toner may not be smoothly charged due to the absorption of excess water that serves as an electric conductor. On the other hand, a toner including silica particles as an external additive tends to be excessively charged in a low-temperature, low-humidity environment, and thus may have ineffective charge stability due to environmental condition changes. Consequently, ineffective toner concentration reproducibility and background staining in a high-temperature, high-humidity environment, or electrostatic staining of an image at low temperature and low humidity may result.

To address a reduction in environmental charge stability caused by moisture, silica particles or titanium oxide particles, each treated with a surface treating agent such as hydrophobic silicone oil or hydrophobic silica coupling agent may be used as an external additive. However using external additive particles surface-treated with such a surface treating agent may enhance cohesiveness of toner particles, and may instead sharply reduce flowability of the toner particles.

In preparing fumed silica particles, the silica particles are frequently apt to form agglomerates, which may lower dispersibility of the fumed silica particles. Using such an external additive with an inherently poor dispersibility may also lower flowability, anti-caking ability, fusability, and cleaning properties of the resulting toner.

To prevent the aggregation of the fumed silica, sol-gel silica may be used. Sol-gel silica powder refers to silica powder prepared using a sol-gel method. For example, sol-gel silica powder may be prepared by hydrolysis and condensation of alkoxy silane in an organic solvent in the presence of water, and removing the solvent from a silica sol suspension resulting from the condensation. Sol-gel silica powder prepared by a sol-gel method may consist of spherical silica particles having a uniform particle size. Conventional sol-gel silica particles have almost perfect spherical shapes. Using silica particles having a sphericity near to 1 as an external additive may deteriorate cleaning properties of the toner that includes the external additive.

Recently, use of small-diameter toner has been steeply increased to provide high image quality. However, using such inorganic particles in preparing small-diameter toner particles does not ensure sufficiently good performance. The smaller the toner diameter, the more ineffective the flowability of the toner particles may become, and the greater the number of inorganic particles may be required as an external additive. The external additive is exposed to friction against a supply roller and a blade or due to stirring within a developing unit during electrophotography. Stress exerted on the toner particle during this process may cause the external additive to be separated from the toner surfaces or to be buried in the toner surfaces. As a result, the toner may have ineffective flowability, may be unable to be smoothly supplied in an electrophotographic imaging system, and may have increased adhesion to a developing roller, resulting in sharp reductions in development characteristics and durability.

The smaller the toner particles become, the higher the charge quantity may become, and the higher the adhesion of the toner particles to a developing roller may become. Consequently, development characteristics of the toner may be deteriorated. The adhesion of the toner particles to a photoreceptor may also be increased, leading to deterioration in transfer characteristics of the toner. The higher the charge quantity becomes, the more the toner may be apt to cause a charge-up in a low-temperature, low-humidity environment. To prevent a charge-up and to improve development characteristics and transfer characteristics of a toner, there is a need to reduce the amount of charges of the small-diameter toner.

SUMMARY

The present general inventive concept provides a toner $T_1$ to develop an electrostatic latent image, the toner $T_1$ having reduced charge-up characteristics, improved development characteristics, and improved transfer characteristics. The toner $T_1$ may ensure high charge stability against environmental condition changes, provide an appropriate amount of charges at a high printing speed, may reduce background contamination on a photoreceptor, may prevent undesirable fusing onto a blade even after prolonged printing, and may have high transfer efficiency and high image uniformity. The toner $T_1$ may have effective flowability and transportability, and may have improved storage stability, so as to be unlikely to cause blocking when stored for an extended time.

Additional features and utilities of the present general inventive concept will be set forth in part in the description which follows and, in part, will be obvious from the description, or may be learned by practice of the general inventive concept.

According to a feature of the present general inventive concept, a toner $T_1$ develops an electrostatic latent image, the toner $T_1$ including a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3 below.

Condition 1: an X-ray diffraction (XRD) intensity of the toner $T_1$ at an angle 2θ (where 2θ is an angle of an x-ray diffraction detector) of 25.3° is larger than about 0.4 counts per second (CPS) of X-rays measured by the detector at the angle of 2θ to less than about 4 CPS;

Condition 2: an XRD intensity of the toner $T_1$ at an angle 2θ of 27.4° is larger than about 34 CPS to less than about 344 CPS; and Condition 3: an XRD intensity of the toner $T_1$ at an angle 2θ of 32.3° is larger than about 92 CPS to less than about 1834 CPS.

The core particle may include an agglomerated core toner particle of a first aggregated particle from a first binder resin latex mixture that is combined with a second binder resin latex mixture. The first aggregated particle is from a first binder resin latex mixture of about 95 wt % of a low molecular weight binder resin latex having a weight average molecular weight of about 25,000 g/mol and a glass transition temperature of about 62° C. and about 5 wt % of a high molecular weight binder resin latex having a weight average molecular weight of about 250,000 g/mol and a glass transition temperature of about 53° C., the first aggregated particle having a particle size of from about 1.5 μm to about 2.5 μm. The first aggregated particle is combined with a second binder resin latex mixture of about 90 wt % of the low molecular weight binder resin latex having the weight average molecular weight of about 25,000 g/mol and the glass transition temperature of about 62° C. and about 10 wt % of the high molecular weight binder resin latex having the weight average molecular weight of about 250,000 g/mol and the glass transition temperature of about 53° C., so that the core particle has a potato shape with a size of about 6.5 μm to about 7.0 μm.

Exemplary embodiments of the present general inventive concept may also provide a toner to develop an electrostatic latent image, the toner $T_1$ comprising: a core particle comprising a binder resin, a colorant, and a releasing agent, and an external additive adhering to an external surface of the core particle. The external additive may include an amount of sol-gel silica that is about 2 parts by weight relative to 100 parts by weight of the core particle; an amount of rutile titanium oxide that is from about 0.25 parts by weight to about 0.75 parts by weight relative to 100 parts by weight of the core particle; an amount of anatase titanium oxide that is from about 0.25 parts by weight to about 0.75 parts by weight relative to 100 parts by weight of the core particle; and an amount of strontium titanium oxide that is from about 0.25 parts by weight to about 0.75 parts by weight relative to 100 parts by weight of the core particle. Intensities of silicon and iron in the toner $T_1$, as measured by X-ray fluorescence spectrometry (XRF), may satisfy the following condition: $0.004 \leq [Si]/[Fe] \leq 0.009$, wherein [Si] denotes the intensity of silicon and [Fe] denotes the intensity of iron.

The toner $T_1$ may satisfy Conditions 1, 2, and 3 below, where 2θ is an angle of an x-ray diffraction detector and CPS is a number of counts per second of X-rays measured by the detector at the angle of 2θ: Condition 1: an X-ray diffraction (XRD) intensity of the toner $T_1$ at an angle 2θ of 25.3° is larger than about 0.4 CPS to less than about 4 CPS; Condition 2: an XRD intensity of the toner $T_1$ at an angle 2θ of 27.4° is larger than about 34 CPS to less than about 344 CPS; and Condition 3: an XRD intensity of the toner $T_1$ at an angle 2θ of 32.3° is larger than about 92 CPS to less than about 1834 CPS.

The amount of sol-gel silica in the toner $T_1$ may be about 2 parts by weight relative to 100 parts by weight of the core particle, the amount of rutile titanium oxide may be about 0.5 parts by weight relative to 100 parts by weight of the core particle, the amount of anatase titanium oxide may be about 0.5 parts by weight relative to 100 parts by weight of the core particle, and the amount of strontium titanium oxide may be about 0.5 parts by weight relative to 100 parts by weight of the core particle.

Exemplary embodiments of the present general inventive concept may also provide a process cartridge that includes an electrostatic charge image bearing member configured to bear an electrostatic charge image and a developing device configured to develop the electrostatic charge image with a toner $T_1$ that develops an electrostatic charge image. The toner $T_1$ includes a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

Exemplary embodiments of the present general inventive concept may also provide a toner device that includes a container to supply a toner $T_1$ that develops an electrostatic charge image. The toner $T_1$ includes a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

Exemplary embodiments of the present general inventive concept may also provide an image forming apparatus that includes an electrostatic charge image forming member configured to bear an electrostatic charge image, an electrostatic charge image forming device configured to form an electrostatic charge image on the electrostatic charge image bearing member, a developing device configured to develop the electrostatic charge image with a toner $T_1$ that develops an electrostatic charge image to form a toner image, a transfer device configured to transfer the toner image onto a recording medium, and a fixing device configured to fix the toner image on the recording medium. The toner $T_1$ includes a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

Exemplary embodiments of the present general inventive concept may also provide an image forming method including the operations of forming an electrostatic charge image on an electrostatic charge image bearing member, developing the electrostatic charge image with the toner $T_1$ to form a toner image, transferring the toner image onto a recording medium, and fixing the toner image on the recording medium. The toner $T_1$ includes a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Figure 1:
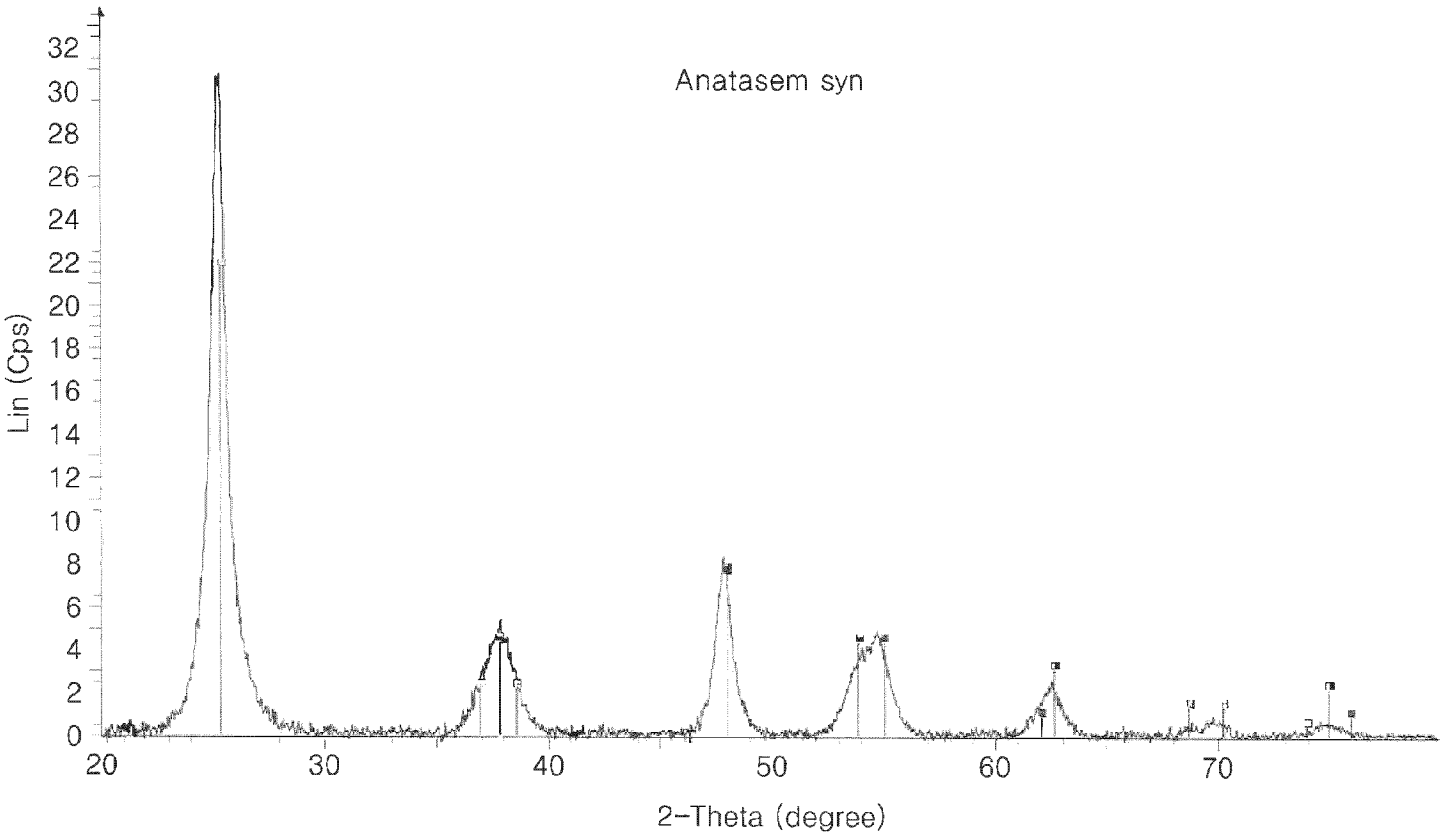
FIG. 1 illustrates an X-ray diffraction (XRD) analysis pattern of anatase titanium dioxide ($TiO_2$)

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. As used herein, the term "and/or" includes any and all combinations of one or more of the associated listed items. Expressions such as "at least one of," when preceding a list of elements, modify the entire list of elements and do not modify the individual elements of the list.

FIG. 1 illustrates an X-ray diffraction (XRD) analysis pattern of anatase titanium dioxide ($TiO_2$). Referring to FIG. 1, feature peaks of anatase titanium dioxide ($TiO_2$) appear at an angle 2θ of 25.3° and 48.0°.

Figure 2:
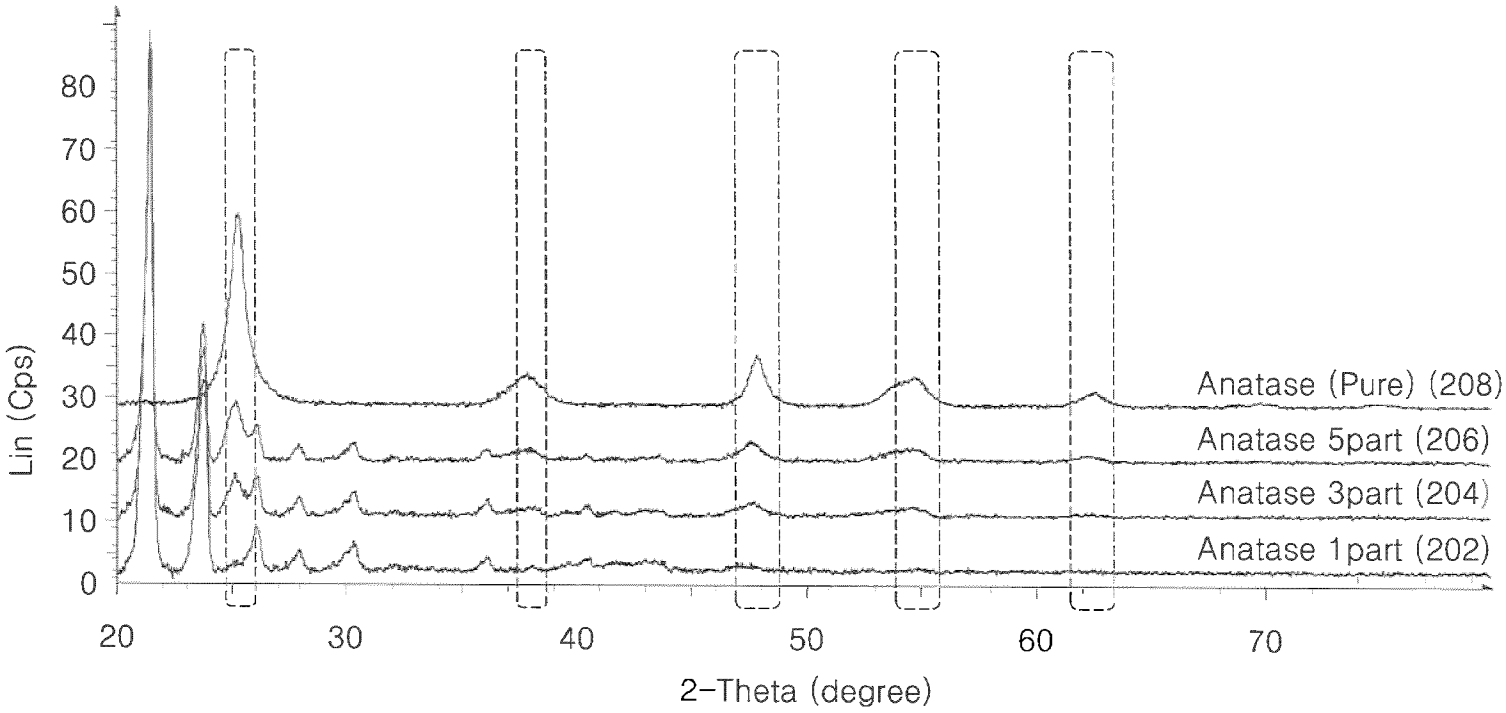
FIG. 2 illustrates an XRD analysis result illustrating an XRD analysis pattern of a toner including 1 part by weight of anatase titanium dioxide as an external additive based on 100 parts by weight of agglomerated core toner particles, an XRD analysis pattern of a toner including 3 parts by weight of anatase titanium dioxide as an external additive based on 100 parts by weight of agglomerated core toner particles, and an XRD analysis pattern of a toner including 5 parts by weight of anatase titanium dioxide as an external additive based on 100 parts by weight of agglomerated core toner particles.

FIG. 2 illustrates an XRD analysis result illustrating an XRD analysis pattern 202 of a toner $T_1$ including 1 part by weight of anatase titanium dioxide as an external additive based on 100 parts by weight of agglomerated core toner particles, an XRD analysis pattern 204 of a toner $T_1$ including 3 parts by weight of anatase titanium dioxide as an external additive based on 100 parts by weight of agglomerated core toner particles, and an XRD analysis pattern 206 of a toner $T_1$ including 5 parts by weight of anatase titanium dioxide as an external additive based on 100 parts by weight of agglomerated core toner particles. Referring to FIG. 2, with increasing amounts of anatase titanium oxide as the external additive of the toner $T_1$, the intensities of the feature peaks of anatase titanium oxide at an angle 2θ of 25.3° and 48.0° are increased. FIG. 2 further illustrates an XRD analysis pattern 208 of a toner $T_1$ including pure anatase titanium dioxide.

Figure 3:
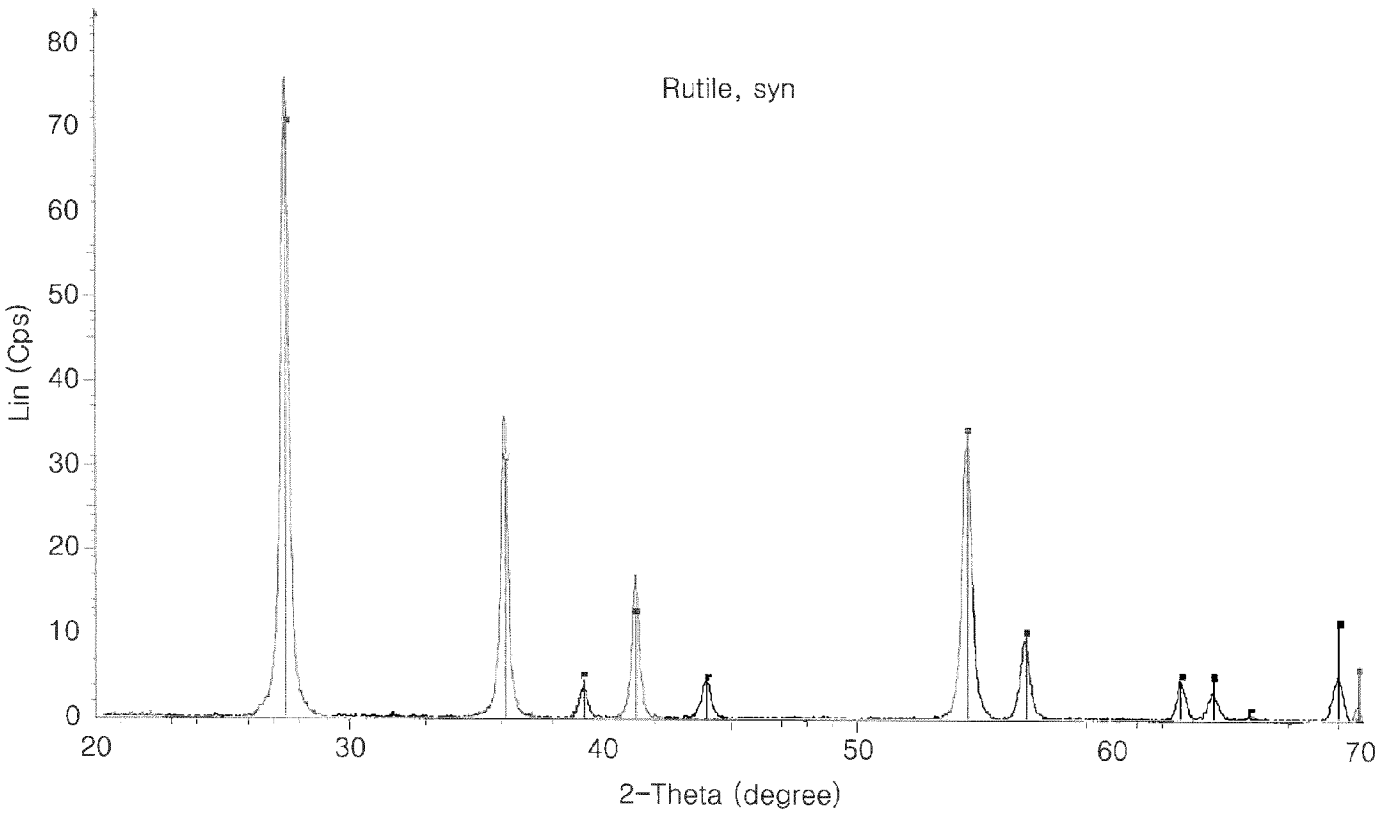
FIG. 3 illustrates an XRD analysis pattern of rutile titanium dioxide.

FIG. 3 illustrates an XRD analysis pattern of rutile titanium dioxide. Referring to FIG. 3, feature peaks of rutile titanium oxide appear at an angle 2θ of 27.4°, 36.1°, and 54.3°.

Figure 4:
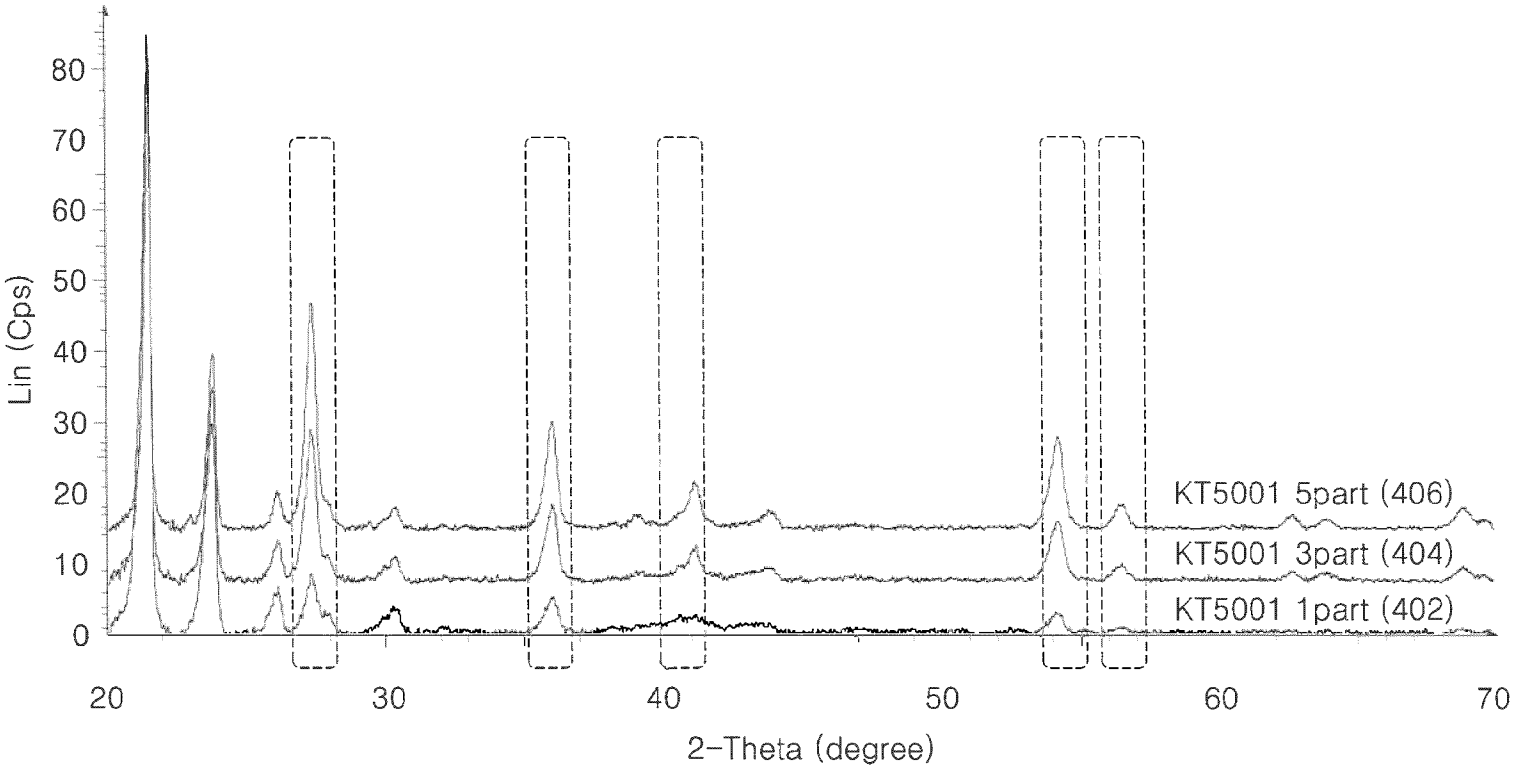
FIG. 4 illustrates an XRD analysis result illustrating an XRD analysis pattern of a toner $T_1$ including 1 part by weight of rutile titanium dioxide as an external additive based on 100 parts by weight of agglomerated core toner particles, an XRD analysis pattern of a toner $T_1$ including 3 parts by weight of rutile titanium dioxide as an external additive based on 100 parts by weight of agglomerated core toner particles, and an XRD analysis pattern of a toner $T_1$ including 5 parts by weight of rutile titanium dioxide as an external additive based on 100 parts by weight of agglomerated core toner particles.

FIG. 4 illustrates an XRD analysis result illustrating an XRD analysis pattern 402 of a toner $T_1$ including 1 part by weight of rutile titanium dioxide as an external additive based on 100 parts by weight of agglomerated core toner particles, an XRD analysis pattern 404 of a toner $T_1$ including 3 parts by weight of rutile titanium dioxide as an external additive based on 100 parts by weight of agglomerated core toner particles, and an XRD analysis pattern 406 of a toner $T_1$ including 5 parts by weight of rutile titanium dioxide as an external additive based on 100 parts by weight of agglomerated core toner particles. Referring to FIG. 4, with increasing amounts of rutile titanium oxide as the external additive of the toner $T_1$, the intensities of the feature peaks of rutile titanium oxide at an angle 2θ of 27.4°, 36.1°, and 54.3° are increased.

Figure 5:
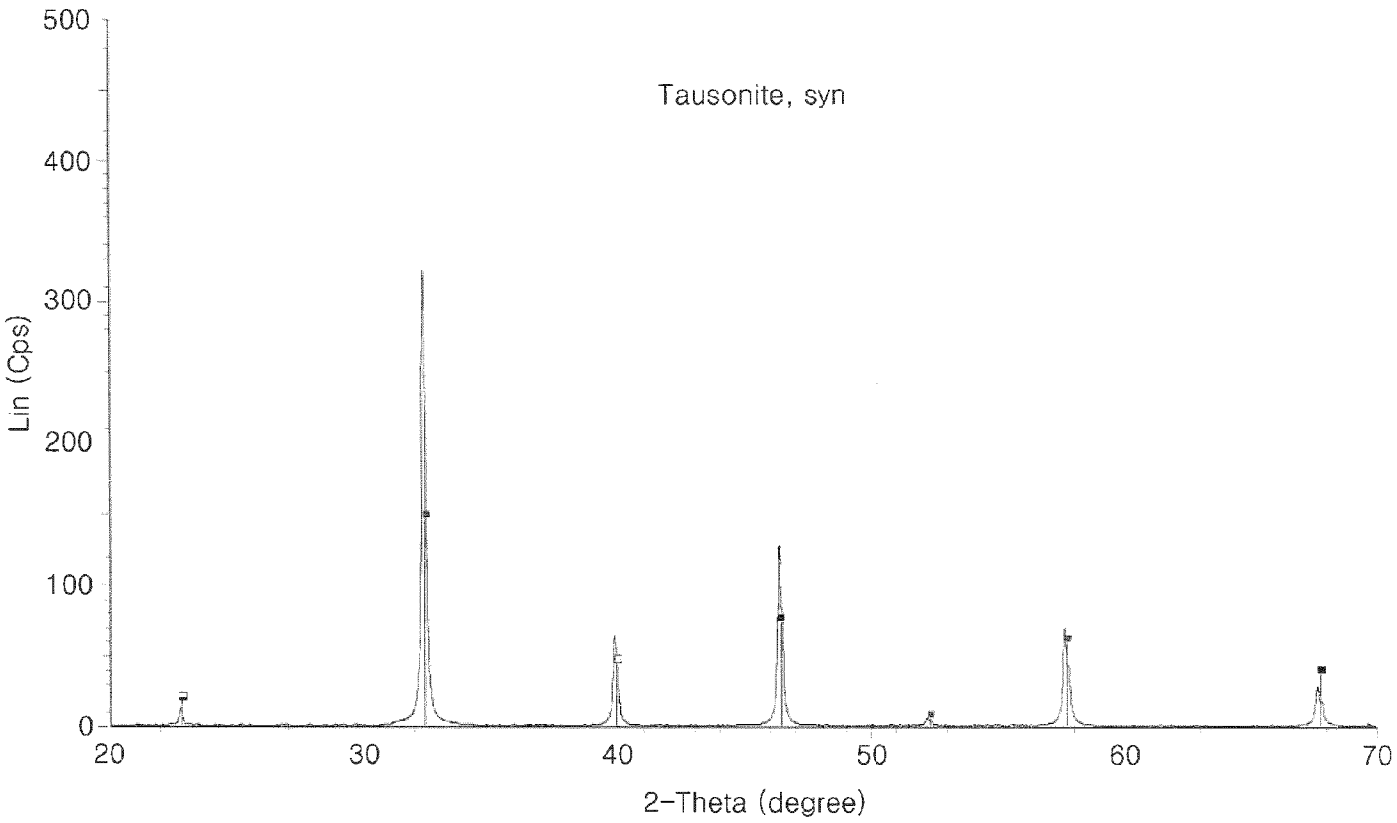
FIG. 5 illustrates an XRD analysis pattern of strontium titanium oxide ($SrTiO_3$)

FIG. 5 illustrates an XRD analysis pattern of strontium titanium oxide ($SrTiO_3$). Referring to FIG. 5, feature peaks of strontium titanium oxide appear at an angle 2θ of 32.4° and 46.4°

Figure 6:
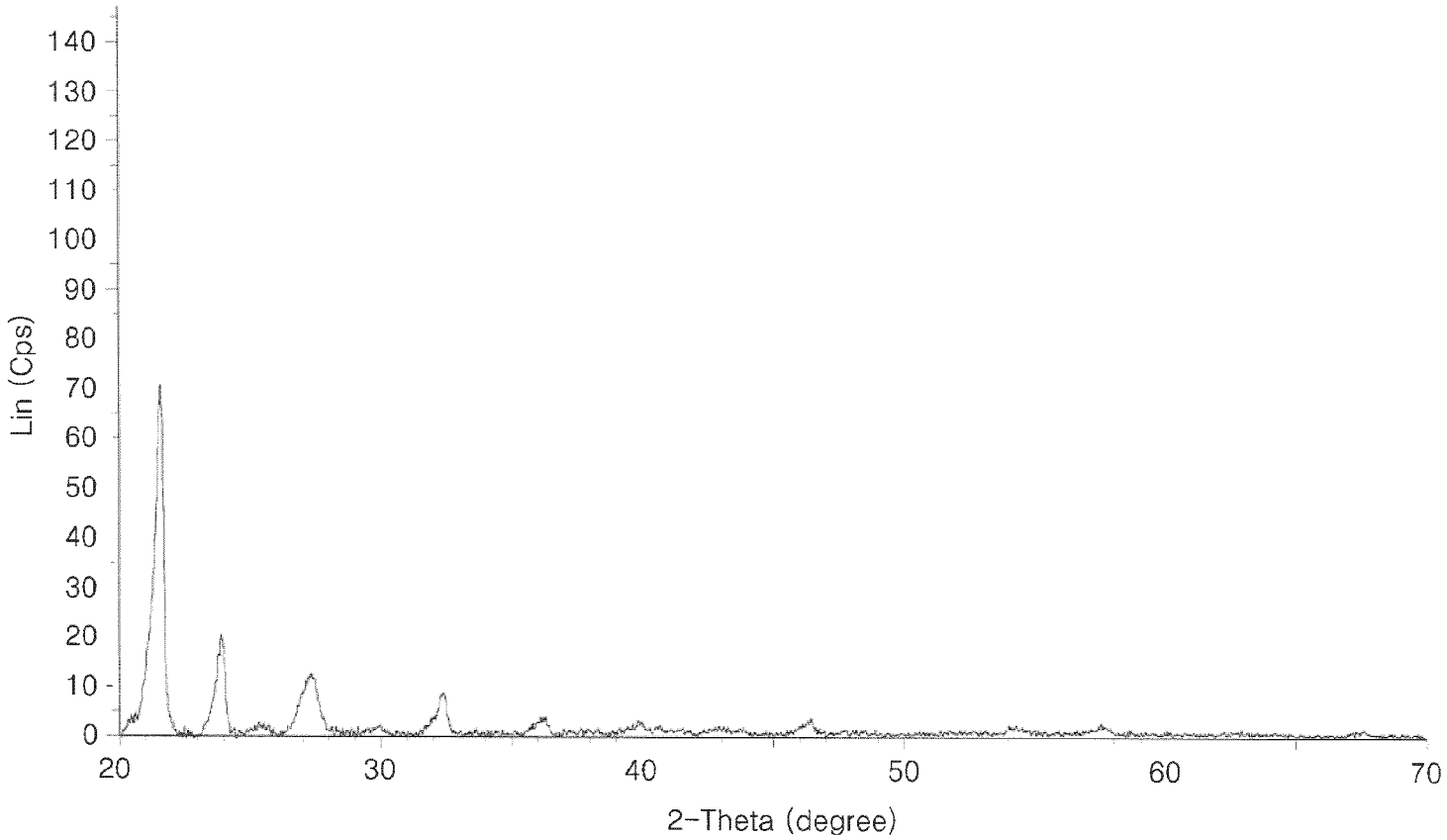
FIG. 6 illustrates an XRD analysis pattern of a toner $T_1$ including an external additive, according to an embodiment of the present general inventive concept, the external additive including 1 part by weight of anatase titanium oxide, 1 part by weight of rutile titanium oxide, and 1 part by weight of strontium titanium oxide, each based on 100 parts by weight of agglomerated core toner particles.

FIG. 6 illustrates an XRD analysis pattern of a toner $T_1$ including an external additive, according to an embodiment of the present general inventive concept, the external additive including 1 part by weight of anatase titanium oxide, 1 part by weight of rutile titanium oxide, and 1 part by weight of strontium titanium oxide, each based on 100 parts by weight of agglomerated core toner particles. Referring to FIG. 6, feature peaks of anatase titanium oxide, rutile titanium oxide, and strontium titanium oxide are apparent. The amounts of anatase titanium oxide, rutile titanium oxide, and strontium titanium oxide in the external additive may be understood from the intensities of these peaks. In particular, the composition of the external additive of the toner $T_1$ may be understood based on the XRD intensities at an angle 2θ of 25.3°, 27.4°, and 32.3°, which indicate the relative amounts of anatase titanium oxide, rutile titanium oxide, and strontium titanium oxide in the external additive, respectively. In exemplary embodiments of the present general inventive concept, the ratio of the relative amounts of anatase titanium oxide, rutile titanium oxide, and strontium titanium oxide in the external additive may be determined according to the ratio of the XRD intensities at an angle 2θ of 25.3°, 27.4°, and 32.3°. That is, in exemplary embodiments of the present general inventive concept, the ratio of the relative amounts of anatase titanium oxide, rutile titanium oxide, and strontium titanium oxide in the external additive may be the same as the ratio of the XRD intensities at an angle 2θ of 25.3°, 27.4°, and 32.3°.

According to an exemplary embodiment of the present general inventive concept of the disclosure, a toner $T_1$ can develop an electrostatic latent image that includes an anatase titanium dioxide, a rutile titanium dioxide, and a strontium titanium oxide to satisfy the following conditions 1, 2, and 3, so as to provide the toner $T_1$ having reduced charge-up characteristics, improved development characteristics, and improved transfer characteristics:

Condition 1: an X-ray diffraction (XRD) intensity of the toner $T_1$ at an angle 2θ of about 25.3° is larger than about 0.4 CPS to less than about 4 CPS;

Condition 2: an XRD intensity of the toner $T_1$ at an angle 2θ of about 27.4° is larger than about 34 CPS to less than about 344 CPS; and Condition 3: an XRD intensity of the toner $T_1$ at an angle 2θ of about 32.3° is larger than about 92 CPS to less than about 1834 CPS.

With regard to Condition 1 above, if the XRD intensity of the toner at an angle 2θ of about 25.3° is less than about 0.4 CPS, the toner may have ineffective development characteristics and reduced transfer characteristics. If the XRD intensity of the toner at an angle 2θ of about 25.3° is larger than about 4 CPS, a background of a photoconductor may be contaminated.

With regard to Condition 2, if the XRD intensity of the toner at an angle 2θ of about 27.4° is less than about 34 CPS, filming on a developing roller may occur. If the XRD intensity of the toner at an angle 2θ of about 27.4° is larger than 344 CPS, a background of a photoconductor may be contaminated, and lifetime durability of the toner may be reduced.

With regard to Condition 3, if the XRD intensity of the toner at an angle 2θ of about 32.3° is less than about 92 CPS, a background of a photoconductor may be contaminated. If the XRD intensity of the toner at an angle 2θ of about 32.3° is larger than about 1834 CPS, lifetime durability of the toner may be reduced.

An external additive of the toner $T_1$ satisfying Conditions 1, 2, and 3 above may include, for example, about 0.1 parts to about 3 parts by weight of silica particles, about 0.1 to about 2 parts by weight of anatase titanium oxide particles, about 0.1 parts to about 2 parts by weight of rutile titanium oxide particles, and about 0.1 to about 2 parts by weight of strontium titanium oxide particles, each component based on 100 parts by weight of core particles. In other words, a toner $T_1$ having an external additive including about 0.1 parts to about 3 parts by weight of silica particles, about 0.1 to about 2 parts by weight of anatase titanium oxide particles, about 0.1 parts to about 2 parts by weight of rutile titanium oxide particles, and about 0.1 to about 2 parts by weight of strontium titanium oxide particles, each component based on 100 parts by weight of core particles, may satisfy all of Conditions 1, 2, and 3. Any external additive having a different composition from the above may also be used provided that it satisfies all of Conditions 1, 2, and 3.

The silica particles may be, for example, fumed silica, sol-gel silica, or a mixture thereof.

When the silica particles have a primary particle size that is too large, it may be relatively difficult for the externally added toner particles to pass through a developing blade, and consequently, a toner selection phenomenon may occur. That is, with prolonged use of a toner cartridge, the size of toner particles remaining in the toner cartridge may gradually increase. Consequentially, a charge quantity of the toner may be reduced, and a toner layer developing the electrostatic latent image may have an increased thickness. When the silica particles have a primary particle size that is too large, the silica particles may be exposed to stress caused by an element, such as a feed roller, and thus may become more likely to be separated from the core particles and may contaminate a charging member or a latent image carrier. On the other hand, when the silica particles have a particle size that is too small, due to a shearing stress which a developing blade may exert on the toner particles, the silica particles may become buried in the core particle. This may cause the silica particles to lose the function as an external additive, disadvantageously leading to increased adhesion between the toner particles and a surface of a photoreceptor, and consequently may result in deterioration in toner cleaning properties and toner transfer efficiency. For example, the silica particles may have a volume average particle size of about 10 nm to about 80 nm, and in some embodiments, about 30 nm to about 80 nm, and in some other embodiments, about 60 nm to about 80 nm.

In some embodiments, the silica particles of the toner $T_1$ may include a large-diameter silica particle having a volume average particle size of about 30 nm to about 100 nm, and a small-diameter silica particle having a volume average particle size of about 5 nm to about 20 nm. Such small-diameter silica particles may provide a larger surface area than such large-diameter silica particles, and thus may further improve charge stability of the toner particles. Since the small-diameter silica particles are located between the large-diameter silica particles and adhered to the core particles, the small-diameter silica particles may not be exposed to an external shear force applied to the toner particles. That is, the external shear force may exert mainly on the large-diameter silica particles of the toner particles. This may prevent the small-diameter silica particles from being buried in the core particles, thereby maintaining the improved charge stability. When an amount of the small-diameter silica particles is much less than an amount of the large-diameter silica particles, the toner may exhibit lower durability and negligible improvement in charge stability. When the amount of the small-diameter silica particles is much greater than an amount of the large-diameter silica particles, a cleaning failure of a charging member or a latent image carrier may occur. A weight ratio of the large-diameter silica particles to small-diameter silica particles may be from about 0.5:1.5 to about 1.5:0.5.

In some embodiments, the silica particles of the toner $T_1$ may include a sol-gel silica particle having a number average aspect ratio of about 0.83 to about 0.97. As used herein, the term "aspect ratio" refers to a ratio of the smallest particle diameter to largest particle diameter of a sol-gel silica particle. In the present disclosure, the number average aspect ratio of the sol-gel silica particles is defined as follows. First, toner particles including sol-gel silica particles as an external additive are analyzed by scanning electron microscopy (SEM) to obtain a 50,000× magnified plane image. The shortest and largest diameters of the sol-gel silica particles appearing on the magnified SEM image are analyzed using an image analyzer to obtain aspect ratios of the sol-gel silica particles. The sum of the aspect ratios is divided by the number of the sol-gel silica particles. The result from the division is defined as a number average aspect ratio of the sol-gel silica particles. In an exemplary embodiment of the present general inventive concept, the number of sol-gel silica particles used to calculate a number average aspect ratio was fixed to fifty. According to an embodiment of the present inventive concept, when sol-gel silica particles having a number average aspect ratio of about 0.83 to about 0.97 are used as an external additive of a toner $T_1$, the toner $T_1$ may have more improved cleaning ability. The improvement in cleaning properties of the toner $T_1$ provides an appropriate corresponding reduction in adhesion between the toner particles and the surface of the photoreceptor. When the toner $T_1$ has improved cleaning properties, untransferred toner $T_1$ remaining after a transfer process in electrophotographic imaging may be almost completely removed by a cleaning blade, so that neither contamination of a charging roller nor filming of the surface of the photoreceptor, both caused by the untransferred toner, may occur. The nano-sized external additive remaining on the photoreceptor is more likely to pass through between the cleaning blade and the photoreceptor when the nano-sized external additive has a spherical particle shape, which makes the particles more apt to rotate. The external additive passed through the blade may contaminate a charging roller. When the aspect ratio of the silica particles is reduced to prevent such contamination, the silica particles as an external additive may have improved cleaning ability.

In some embodiments, the sol-gel silica particle may be obtained by hydrolysis and condensation of alkoxy silane in an organic solvent in the presence of water and removing the solvent from a silica sol suspension resulting from the condensation.

As the external additive of the toner $T_1$, the titanium oxide particles may include anatase titanium oxide having an anatase crystal structure, and rutile titanium oxide having a rutile crystal structure. The use of titanium oxide as the external additive of the toner $T_1$ may prevent a charge-up caused from the use of only silica with strong negative charges as an external additive of the toner $T_1$, specifically formation of a thicker toner layer on a developing roller of a contact development system due to adhering of more toner particles. In a non-contact development system, due to high charge quantity, development characteristics may be ineffective when titanium oxide is not used, so that an image density may also be low. To stabilize a sharp change in charge quantity, caused from the exclusive use of silica as an external additive, titanium oxide may be added to prevent a deviation in charge quantity in a high-temperature, high-humidity environment or a low-temperature, low-humidity environment, and may reduce a charge-up effect. However, the use of excess titanium oxide may cause a background contamination. The ratio between silica with strong negative charges and titanium oxide with weak negative charges is a significant factor affecting charge quantity, durability, image contamination or the like in an electrophotographic system. The use of anatase titanium oxide and rutile titanium oxide together may significantly prevent filming on the developing roller, compared to using anatase titanium oxide alone. The use of anatase titanium oxide and rutile titanium oxide together may significantly reduce a charge-up, compared to using rutile titanium oxide alone. The amounts of the anatase titanium oxide and the rutile titanium oxide may be selected to satisfy Condition 1 (an X-ray diffraction (XRD) intensity of the toner $T_1$ at an angle $2\theta$ of about 25.3° is larger than about 0.4 CPS and less than about 4 CPS) and Condition 2 (an XRD intensity of the toner $T_1$ at an angle $2\theta$ of about 27.4° is larger than about 34 CPS and less than about 344 CPS). The titanium oxide particles may have a volume average particle size of, for example, about 10 nm to about 60 nm. In some embodiments, the titanium oxide particles may have a Brunauer-Emmett-Tellr (BET) specific surface area of, for example, about 30 $m^2/g$ to about 80 $m^2/g$.

As the external additive of the toner $T_1$, the strontium titanium oxide particles may provide the toner $T_1$ with a distinct charge distribution, and consequently further reduce an OPC background contamination. The strontium titanium oxide particles may have a volume average particle size of, for example, about 50 nm to about 150 nm. When the strontium titanium oxide particles have a volume average particle size less than about 50 nm, the charging roller may be contaminated. When the strontium titanium oxide particles have a volume average particle size larger than 150 nm, the strontium titanium oxide particles may be more likely to be separated from the toner $T_1$.

The silica particles and the titanium oxide particles may be treated hydrophobically with, for example, silicone oils, silanes, siloxanes, or silazanes. The silica particles and the titanium oxide particles may each independently have a degree of hydrophobicity of about 10 to about 90. A degree of hydrophobicity is a value determined by a methanol titration method known in the art. For example, determination of a degree of hydrophobicity of, for example, silica particles or titanium oxide particles may involve adding 0.2 g of the silica particles or titanium oxide particles into 100 ml of ion-exchanged water in a 2 L or larger glass beaker having an inner diameter of about 7 cm, adding 20 ml of methanol into the mixed solution with a burette while stirring with a magnetic stirrer, stopping the stirring after 30 seconds, and observing the status of the mixed solution after about 1 minute. These processes are repeated to determine a total amount of methanol added (Y in ml) until no silica particle floats on the surface of the mixed solution. Then, the total amount of the added methanol is used to calculate the degree of hydrophobicity with the following equation. The temperature of the ion-exchanged water in the glass beaker is maintained at about 20° C.±1° C.

$$\text{Degree of hydrophobicity}=[Y/(100+Y)]\times 100.$$

The core particles of the toner $T_1$ may include a binder resin, a colorant, and a releasing agent.

Non-limiting examples of the binder resin are styrene resin, acryl resin, vinyl resin, polyether polyol resin, phenol resin, silicon resin, polyester resin, epoxy resin, polyamide resin, polyurethane resin, polybutadiene resin, or a mixture thereof.

Non-limiting examples of the styrene resin are polystyrene; a homopolymer of styrene derivatives, such as poly-p-chlorostyrene or polyvinyltoluene; a styrene-based copolymer, such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-α-chloromethacrylic acid methyl copolymer, a styrene-acrylonitrile copolymer, a styrene-vinylmethylether copolymer, a styrene-vinylethylether copolymer, a styrene-vinylmethylketone copolymer, a styrene-butadiene copolymer, a styrene-isoprene copolymer, or a styrene-acrylonitrile-indene copolymer; or a mixture thereof.

Non-limiting examples of the acryl resin are an acrylic acid polymer, a methacrylic acid polymer, a methacrylic acid methylester polymer, an α-chloromethacrylic acid methylester polymer, or a mixture thereof.

Non-limiting examples of the vinyl resin are a vinyl chloride polymer, an ethylene polymer, a propylene polymer, an acrylonitrile polymer, a vinyl acetate polymer, or a mixture thereof.

For example, the binder resin may have a number average molecular weight of about 700 to about 1,000,000, and in some embodiments, about 10,000 to about 200,000.

Non-limiting examples of the colorant are a black colorant, a yellow colorant, a magenta colorant, a cyan colorant, or a mixture thereof.

Non-limiting examples of the black colorant are carbon black, aniline black, or a mixture thereof.

Non-limiting examples of the yellow colorant are condensation nitrogen compounds, isoindolelinone compounds, anthraquinone compounds, azo metal complexes, arylamide compounds, or mixtures thereof, and specifically, "C.I. pigment yellows" 12, 13, 14, 17, 62, 74, 83, 93, 94, 95, 109, 110, 111, 128, 129, 147, 168 or 180, where "CA." indicates Color Index.

Non-limiting examples of the magenta colorant are condensed nitrogen compounds, anthraquine compounds, quinacridone compounds, base dye lake compounds, naphthol compounds, benzo imidazole compounds, thioindigo compounds, perylene compounds, or mixtures thereof, and specifically, "C.I. pigment reds" 2, 3, 5, 6, 7, 23, 48:2, 48:3, 48:4, 57:1, 81:1, 122, 144, 146, 166, 169, 177, 184, 185, 202, 206, 220, 221, or 254.

Non-limiting examples of the cyan colorant are copper phthalocyanine compounds and derivatives thereof, anthraquinone compounds, base dye lake compounds, or mixtures thereof, and specifically "C.I. pigment blues" 1, 7, 15, 15:1, 15:2, 15:3, 15:4, 60, 62, or 66.

An amount of the colorant of the core particles may be from about 0.1 parts by weight to about 20 parts by weight, and in some embodiments, from about 2 parts by weight to about 10 parts by weight, each based on 100 parts by weight of the binder resin.

Non-limiting examples of the releasing agent are polyethylene-based wax, polypropylene-based wax, silicon-based wax, paraffin-based wax, ester-based wax, carnauba-based wax, metallocene wax, or mixtures thereof.

For example, the releasing agent may have a melting point of from about 50° C. to about 150° C.

An amount of the releasing agent of the core particles may be from about 1 part by weight to about 20 parts by weight, and in some embodiments, from about 1 part by weight to about 10 parts by weight, each based on 100 parts by weight of the binder resin.

The core particles may be prepared using, for example, pulverization, agglomeration, or spraying, but embodiments of the present general inventive concept are not limited thereto. For example, pulverization may involve melt-mixing a binder resin, a colorant, and a releasing agent, and pulverizing the mixture. For example, agglomeration may involve mixing a binder resin dispersion, a colorant dispersion, and a releasing agent dispersion, agglomerating particles in the mixture to obtain agglomerates, and unifying the agglomerates.

The core particles of the toner $T_1$ may have a volume average particle size of about 4 μm to about 20 μm, and in some embodiments, from about 5 μm to about 10 μm.

A shape of the core particles is not specifically limited. The more spherical the shape of the core particles is, the greater the charge stability and the dot reproducibility of printed images the toner $T_1$ may have. For example, the core particles may have a sphericity of about 0.90 to about 0.99.

In some embodiments, the toner $T_1$ may be prepared by adhering the external additive particles to the surface of the core particles. Adhering the external additive particles to the surface of the core particles core particles may be performed using, for example, a powder mixing apparatus. Non-limiting examples of the powder mixing apparatus are a Henshell mixer, a V-shape mixer, a ball mill, or a nauta mixer.

In some other embodiments, the intensities of Fe and Si, which are represented by [Fe] and [Si], respectively, in the toner $T_1$, may satisfy the following condition: $0.004 \leq [Si]/[Fe] \leq 0.009$.

[Fe] and [Si] in the toner $T_1$ may be measured by X-ray fluorescence spectrometry (XRF). In the present general inventive concept, an X-ray fluorescence measurement was performed using an energy dispersive X-ray spectrometer (EDX-720, available from SHIMADZU CORP.). An X-ray tube voltage was 50 kV, and the amounts of samples that were molded were about 3 g±0.01 g, the amounts of Fe and Si were calculated using intensities (unit: cps/μA) obtained from the X-ray fluorescence measurement.

When a ratio of [Si]/[Fe] is less than 0.004, development/transfer characteristics and durability of the toner may be deteriorated. When a ratio of [Si]/[Fe] is larger than 0.009, a charging member or latent image carrier may more likely be contaminated due to a cleaning failure. Accordingly, when a toner $T_1$ includes [Fe] and [Si] satisfying the above condition, the toner $T_1$ may have improved performance in every aspect.

The amount of Si is derived dominantly from silica of the external additive. The amount of Fe is derived from an agglomerating agent used in preparing the core particle. Accordingly, the ratio of [Si]/[Fe] may be appropriately selected by adjusting the amount of silica of the external additive relative to the amount of the core particle including Fe.

In some other embodiments, the toner may have a dielectric loss factor of about 0.01 to about 0.03. When the toner has a reduced dielectric loss factor, a charge quantity of the toner may be rapidly increased in a low-humidity environment, which may consequently cause a charge-up and lower image density. On the other hand, when the toner has a dielectric loss factor that is too great, the toner may not be charged smoothly, so that electric charges of the toner may be reduced and have a wider distribution. The dielectric loss factor of the toner is closely associated with the type and amount of titanium oxide.

To determine the dielectric loss factor of the toner $T_1$, 8 g of the toner sample was pressed in a 50 mm-disc molder by a presser to a thickness of about 3.9 mm. The toner sample was analyzed using a precision component analyzer (Model 6440B, available from WAYNE KERR) at a voltage of 5.00 Vac and a frequency of 2.0000 KHz, and the dielectric loss factor was calculated using Equations (1) and (2) below.

$$\in'=(t\times C)/(\pi\times(d/2)^2\times\in_o) \quad (1)$$

$$\tan\delta=\in''/\in' \quad (2)$$

where $\in'$ denotes a dielectric loss factor, C denotes an electric capacity, tan δ denotes a loss tangent, and $\in'$ denotes a specific dielectric constant.

In some embodiments, the toner $T_1$ may have a degree of hydrophobicity of about 30 to about 60. When the toner has a degree of hydrophobicity that is greatly reduced, the toner may more likely absorb moisture in a high-humidity environment, and thus may have a reduced electric charge quantity, which may increase toner consumption, and lead to a reduced toner flowability due to the moisture absorption, failing to ensure a smooth supply of the toner. On the other hand, when the toner has a too great of a degree of hydrophobicity, a filming may occur on the surface of the photoreceptor due to use of excess surface treating agent. The degree of hydrophobicity of the toner $T_1$ may be varied depending on the type and the amount of the surface treating agent of the external additive.

The degree of hydrophobicity of the toner refers to a value determined by a methanol titration method known in the art. For example, determining the degree of hydrophobicity of the toner may involve adding 0.2 g of the toner particles into 100 ml of ion-exchanged water in a 2 L or larger glass beaker having an inner diameter of about 7 cm, adding 20 ml of methanol into the mixed solution with a burette while stirring with a magnetic stirrer, stopping the stirring after 30 seconds, and observing the status of the mixed solution after about 1 minute. These processes are repeated to determine a total amount of methanol added (Y in ml) until no toner particle floats on the surface of the mixed solution. Then, the total amount of the added methanol is used to calculate the degree of hydrophobicity with the following equation. The temperature of the ion-exchanged water in the glass beaker is maintained at about 20° C.±1° C.

$$\text{Degree of hydrophobicity}=[Y/(100+Y)]\times100.$$

One or more embodiments will now be described in more detail with reference to the following examples. However, these examples are for illustrative purposes only and are not intended to limit the scope of the one or more embodiments.

EXAMPLES

Preparation Example 1

Low-Molecular Weight Binder Resin Latex

A polymerizable monomer mixed solution (825 g of styrene and 175 g of n-butyl acrylate), 30 g of β-carboxyethylacrylate (Sipomer, Rhodia), 17 g of 1-dodecanethiol as a chain transfer agent, 418 g of a 2 wt % aqueous solution of sodium dodecyl sulfate as an emulsifier were added to a 3 L-beaker and stirred to prepare a polymerizable monomer emulsion.

16 g of ammonium persulfate as an initiator and 696 g of a 0.4 wt % aqueous sodium dodecyl sulfate solution as an emulsifier were added to a 3 L-double-jacketed reactor, and stirred to prepare a medium for polymerization reaction, which was then heated to about 75° C., followed by adding the polymerizable monomer emulsion dropwise over about 2 hours while stirring. This reaction mixture was then further reacted at about 75° C. for about 8 hours to achieve polymerization so as to obtain a low-molecular weight binder resin latex.

A particle size of the low-molecular weight binder resin latex was measured by the light scattering method using a coulter counter (available from BECKMAN COULTER, INC.). The low-molecular weight binder resin had a particle size of from about 180 nm to about 250 nm. The solid content of the low-molecular weight binder resin latex, measured using a loss-on-drying method, was about 42 wt %. The low-molecular weight binder resin latex had a weight average molecular weight (Mw) of about 25,000 g/mol, measured as a weight average molecular weight of a tetrahydrofuran (THF)-soluble component using gel permeation chromatography (GPC). A glass transition temperature of the low-molecular weight binder resin latex, measured using differential scanning calorimetry (DSC) by scanning twice at a temperature increase rate of 10° C./min, was about 62° C.

Preparation Example 2

High-Molecular Weight Binder Resin Latex

A polymerizable monomer mixed solution (685 g of styrene and 315 g of n-butyl acrylate), 30 g of β-carboxyethylacrylate, and 418 g of a 2 wt % aqueous solution of sodium dodecyl sulfate as an emulsifier were added to a 3 L-beaker and stirred to prepare a polymerizable monomer emulsion.

5 g of ammonium persulfate as an initiator and 696 g of a 0.4 wt % aqueous sodium dodecyl sulfate solution as an emulsifier were added to a 3 L-double-jacketed reactor, and stirred to prepare a medium for polymerization reaction, which was then heated to about 60° C., followed by adding the polymerizable monomer emulsion dropwise over about 3 hours while stirring. This reaction mixture was then further reacted at about 75° C. for about 8 hours to achieve polymerization so as to obtain a high-molecular weight binder resin latex.

A particle size of the high-molecular weight binder resin latex was measured by light scattering using a HORIBA 910 analyzer. The large-molecular weight binder resin had a particle size of from about 180 nm to about 250 nm. The solid content of the high-molecular weight binder resin latex, measured using a loss-on-drying method, was about 42 wt %. The high-molecular weight binder resin latex had a weight average molecular weight (Mw) of about 250,000 g/mol, measured as a weight average molecular weight of a tetrahydrofuran (THF)-soluble component using gel permeation chromatography (GPC). A glass transition temperature of the high-molecular weight binder resin latex, measured using differential scanning calorimetry (DSC) by scanning twice at a temperature increase rate of 10° C./min, was about 53° C.

Preparation Example 3

Preparation of Pigment Dispersion 10 g of sodium dodecyl sulfate as an anionic reactive emulsifier, 60 g of a carbon black pigment, 400 g of glass beads having a diameter of about 0.8 mm to about 1.0 mm, and 500 g of a dispersion medium (distilled water) were loaded into a milling bath and milled at room temperature to prepare a pigment dispersion. A particle size of the pigment in the pigment dispersion was measured by light scattering using a HORIBA 910 analyzer. The particle size of the pigment in the pigment dispersion was from about 180 nm to about 200 nm. The solid content of the pigment dispersion was about 18.5 wt %.

Preparation Example 4

Preparation of Wax Dispersion 300 g of deionized water, 10 g of sodium dodecyl sulfate as an anionic reactive emulsifier, and 90 g of Carnauba Wax (No. 1, available from NIPPON OIL & FATS CO., LTD) were put into a reactor and stirred using a homogenizer at about 90° C. at about 14,000 rpm for about 20 minutes to prepare a wax dispersion. A particle size of the wax in the wax dispersion, measured by light scattering using a Horiba 910 analyzer, was from about 250 nm to about 300 nm. The solid content of the wax dispersion was about 30.5 wt %.

Preparation Example 5

Preparation of Agglomerated Toner 3,000 g of deionized water, 700 g of a binder resin latex mixture for a core (95 wt % of the low-molecular weight binder resin latex of Preparation Example 1, and 5 wt % of the high-molecular weight binder resin latex of Preparation Example 2), 195 g of the carbon black pigment dispersion of Preparation Example 3, 237 g of the wax dispersion of Preparation Example 4, 364 g of a 0.3 M aqueous nitric acid solution, and 182 g of indium polysilicate were put into a 7 L-reactor, and then stirred using a homogenizer at about 11,000 rpm for about 6 minutes, followed by further adding 417 g of the binder resin latex mixture (95 wt % of the low-molecular weight binder resin latex of Preparation Example 1 and 5 wt % of the high-molecular weight binder resin latex of Preparation Example 2) and stirring for about 6 minutes to obtain a reaction mixture including aggregated particles having a particle size of from about 1.5 μm to about 2.5 μm.

The reaction mixture was put into a 7 L-double-jacketed reactor, and subjected to a temperature increase to about 55° C. (equivalent to a temperature lower by 5° C. from Tg of the latex) from room temperature at a rate of 0.5° C. per minute. When a volume average particle size of the aggregated particles in the reaction mixture reached about 6 μm, 442 g of a binder resin latex mixture (90 wt % of the low-molecular weight binder resin latex of Preparation Example 1 and 10 wt % of the large-molecular weight binder resin of Preparation Example 2) was further added slowly over about 20 minutes. When a volume average particle size (D50) of the aggregated particles in the reaction mixture reached about 6.8 μm, a 1 M aqueous NaOH solution was added to adjust a pH of the reaction mixture to about 7.0. After the volume average particle size (D50) of the reaction mixture was maintained constant for about 10 minutes, the temperature of the reaction mixture was increased to about 96° C., followed by adjusting the pH of the reaction mixture to about 6.0 and then, for about 5 hours, unifying the aggregated particles in the reaction mixture, thereby forming toner particles in a potato shape having a size of about 6.5 μm to about 7.0 μm in the reaction mixture. Then, the reaction mixture was cooled to room temperature and filtered to separate the toner particles from the reaction mixture. The toner particles were then dried at about 40° C. for about 24 hours to obtain agglomerated core particles.

Examples 1 to 7

Preparation of Toner Particles Including External Additives

External additives were added to surfaces of the agglomerated core particles of Preparation Example 5 by using a mixer (KM-LS2K). Sol-gel silica (SUKGYUNG AT CO. LTD. SG50, Particle size: 70 nm, Apparent density: 220 g/L), rutile titanium dioxide (EIWA CO., KT501: Particle size: 50 nm, hydrophobic-treated with PDMS), anatase titanium dioxide (SUKGYUNG AT CO. LTD., SGT50, Particle size: 50 nm, hydrophobic-treated with DMDES), and strontium titanium oxide ($SrTiO_3$) (TITANIUM INDUSTRY CO., LTD., Particle size: 100 nm) were used as external additives in different amounts in Examples 1 to 7 to prepare toner $T_1$ particles including external additives. Compositions of the toner particles including external additives in Examples 1 to 7 are summarized in Table 1.

Comparative Examples 1 to 6

Preparation of Toner Particles Including External Additives

External additives were added to surfaces of the agglomerated core particles of Preparation Example 5 by using a mixer (KM-LS2K). Sol-gel silica (SUKGYUNG AT CO. LTD. SG50, Particle size: 70 nm, Apparent density: 220 g/L), rutile titanium dioxide (EIWA CO., KT501: Particle size: 50 nm, hydrophobic-treated with PDMS), anatase titanium dioxide (SUKGYUNG AT CO. LTD., SGT50, Particle size: 50 nm, hydrophobic-treated with DMDES), and strontium titanium oxide ($SrTiO_3$) (TITANIUM INDUSTRY CO., LTD., Particle size: 100 nm) were used as external additives in different amounts in Comparative Examples 1 to 6 to prepare toner particles including external additives. Compositions of the toner particles including external additives in Comparative Examples 1 to 6 are summarized in Table 1.

TABLE 1

| Example | Core particle (parts by weight) | Sol-gel silica (parts by weight) | Rutile titanium oxide (parts by weight) | Anatase titanium oxide (parts by weight) | Strontium titanium oxide (parts by weight) |
|---|---|---|---|---|---|
| Example 1 | 100 | 2.0 | 0.25 | 0.50 | 0.50 |
| Example 2 | 100 | 2.0 | 0.50 | 0.50 | 0.50 |
| Example 3 | 100 | 2.0 | 0.75 | 0.50 | 0.50 |
| Example 4 | 100 | 2.0 | 0.50 | 0.25 | 0.50 |
| Example 5 | 100 | 2.0 | 0.50 | 0.75 | 0.50 |
| Example 6 | 100 | 2.0 | 0.50 | 0.50 | 0.25 |
| Example 7 | 100 | 2.0 | 0.50 | 0.50 | 0.75 |
| Comparative Example 1 | 100 | 2.0 | 1.00 | 0.50 | 0.50 |
| Comparative Example 2 | 100 | 2.0 | 0.10 | 0.50 | 0.50 |
| Comparative Example 3 | 100 | 2.0 | 0.50 | 1.00 | 0.50 |
| Comparative Example 4 | 100 | 2.0 | 0.50 | 0.10 | 0.50 |
| Comparative Example 5 | 100 | 2.0 | 0.50 | 0.50 | 1.00 |
| Comparative Example 6 | 100 | 2.0 | 0.50 | 0.50 | 0.10 |

XRD Intensity Measurement

XRD intensities of the toner $T_1$ particles of Examples 1 to 7 and Comparative Examples 1 to 6, each including external additives, were measured using "Cu K-alpha radiation" (40 Kv, 40 mA) in a continuous scan mode at a scanning rate of about 4° C./min and a 2θ of about 20~80°. The results of the XRD intensity measurement are shown in Table 2.

TABLE 2

| Example | XRD Intensity (CPS) @ 2θ = 25.3° | XRD Intensity (CPS) @ 2θ = 27.4° | XRD Intensity (CPS) @ 2θ = 32.3° |
|---|---|---|---|
| Example 1 | 1 | 172 | 917 |
| Example 2 | 2 | 172 | 917 |
| Example 3 | 3 | 172 | 917 |
| Example 4 | 2 | 86 | 917 |
| Example 5 | 2 | 215 | 917 |
| Example 6 | 2 | 172 | 459 |
| Example 7 | 2 | 172 | 1146 |
| Comparative Example 1 | 4 | 172 | 917 |
| Comparative Example 2 | 0.4 | 172 | 917 |
| Comparative Example 3 | 2 | 344 | 917 |
| Comparative Example 4 | 2 | 34 | 917 |
| Comparative Example 5 | 2 | 172 | 1834 |
| Comparative Example 6 | 2 | 172 | 91.7 |

Evaluation Methods Characteristics of the toner $T_1$ particles of Examples 1 to 7 and Comparative Examples 1 to 6, each including external additives, were evaluated as follows. Cohesiveness (Carr's cohesion) of each toner was evaluated as flowability of the toner. To evaluate printed image quality, a commercially available non-magnetic one-component development type printer (Model: CLP-620, tandem mode, 20 ppm, available from SAMSUNG ELECTRONICS CO., LTD.) with a non-contact developing unit was fed with each toner to print about 5,000 sheets of paper at 1% coverage. Development characteristics, transfer characteristics, image density, image contamination, and changes with time (changes in thickness of a toner layer on the developing roller and in image density with respect to the number of printing sheets) were evaluated in different printing environments.

Cohesiveness of Toner

Equipment: Hosokawa Micron Powder Tester PT-S

Amount of sample: 2 g

Amplitude: 1 mm Dial 3~3.5

Sieve size: 53 μm, 45 μm, 38 μm

Vibration time: 120±0.1 sec

After being stored at room temperature (25° C.) and a relative humidity of 55±5% for about 2 hours, each toner sample was sieved under the above conditions. The weights of the toner before and after the sieving were measured. The toner cohesiveness was calculated as follows.

$$[\text{Mass of toner powder remaining on 53 } \mu\text{m–sieve}/2\text{ g}]\times 100\times 0.2 \quad (1)$$

$$[\text{Mass of toner powder remaining on 45 } \mu\text{m–sieve}/2\text{ g}]\times 100\times 0.6 \quad (2)$$

$$[\text{Mass of toner powder remaining on 38 } \mu\text{m–sieve}/2\text{ g}]\times 100\times 0.2 \quad (3)$$

$$\text{Carr's cohesion}=(1)+(2)+(3)$$

Cohesion evaluation criteria

◎: Cohesion≤10 (very effective flowability)

○: 10<Cohesion≤15 (effective flowability)

Δ: 15<Cohesion≤20 (reduced flowability)

x: 20<Cohesion (very reduced flowability)

Development Characteristics

A toner image of a selected size was developed on a photoreceptor by a developing roller before being transferred onto an intermediate transfer medium. The weight of the toner per unit area of the photoreceptor, and the weight of the toner per unit area of the developing roller were measured using a filter-equipped suction apparatus to evaluate developability as follows.

Development efficiency=Weight of toner per unit area of photoreceptor/Weight of toner per unit area of developing roller ◎: 90%≤Development efficiency ○: 80%≤Development efficiency Δ: 70%≤Development efficiency x: 60%≤Development efficiency Transfer Characteristics (Transferability)

Primary transferability was evaluated by comparing the weight of the toner per unit area of an intermediate transfer medium after the transfer onto the intermediate transfer medium, with the toner weight per unit area of the photoreceptor before the transfer onto the intermediate transfer medium. Secondary transferability was evaluated based on a weight ratio of the toner per unit area of paper transferred from the intermediate transfer medium to the toner per unit area of the intermediate transfer medium before the transfer onto the paper. The weight of the toner per unit area of the paper was measured from an unfixed image.

Primary transfer efficiency=Weight of toner per unit area of an intermediate transfer medium/Weight of toner per unit area of a photoreceptor Secondary transfer efficiency=Weight of toner per unit area of paper/Weight of toner per unit area of an intermediate transfer medium Transfer efficiency=Primary transfer efficiency×Secondary transfer efficiency ◎: 90%≤Transfer efficiency ○: 80%≤Transfer efficiency Δ: 70%≤Transfer efficiency x: 60%≤Transfer efficiency Photoreceptor Background Contamination After printing of 10 sheets, three non-image spots on the photoreceptor drum were taped. Optical densities of the three non-image spots were measured using a reflection densitometer (available from ELECTROEYE) and averaged.

◎: optical density<0.03

○0.03≤optical density<0.05

Δ: 0.05≤optical density<0.07 x: 0.07≤optical density

Image Contamination from Charge-Up

A degree of image contamination caused due to a charge-up in a low-temperature and low-humidity (LL) environment with a prolonged image output was evaluated. In a LL environment where charge quantity is great, a charge-up highly likely occurs to cause image contamination in the same manner of background contamination. The degree of image contamination was evaluated according to the following four criteria.

◎: No image contamination

○: Slight image contamination

Δ: High image contamination x: Very high image contamination

Lifetime Durability (Variations Over Time)

Variations in weight of the toner adhering to the developing roller during repeated printing were measured. A degree of variation in weight of the toner per unit area of the developing roller after printing of 5,000 sheets relative to the weight of the toner after printing of the first sheet was evaluated according to the following criteria.

◎: A weight of toner per unit area of a developing roller after printing 5,000 sheets was increased less than 10% relative to that of the initial phase.

○: A weight of toner per unit area of a developing roller after printing 5,000 sheets was increased 10% or more to less than 20% relative to that of the initial phase.

Δ: A weight of toner per unit area of a developing roller after printing 5,000 sheets was increased 20% or more to less than 30% relative to that of the initial phase.

x: A weight of toner per unit area of a developing roller after printing 5,000 sheets was increased 30% or more relative to that of the initial phase.

Filming on Developing Roller

While printing of 5,000 sheets, a degree of contamination of the developing roller with the toner or external additive was evaluated. Whether the toner or external additive caused a filming on the developing roller was determined based on the color of the developing roller. For example, the external additive in white may cause a white filming on the developing roller. Printing was stopped after printing of 5,000 sheets to visually observe the surface of the developing roller. The results of the visual inspection were classified according to the following criteria.

◎: No filming of toner or external additive occurred on the developing roller after printing of 5,000 sheets.

○: Almost no filming of toner or external additive occurred on the developing roller after printing of 5,000 sheets.

Δ: Slight filming of toner or external additive occurred on the developing roller after printing of 5,000 sheets.

x: Severe filming of toner or external additive occurred on the developing roller after printing of 5,000 sheets.

The evaluation results of the toner $T_1$ particles of Examples 1 to 7 and Comparative Examples 1 to 6, each including external additives, were summarized in Table 3.

TABLE 3

| Sample | Image contamination (charge up) | Development/ transfer characteristics | Photoreceptor background contamination | Lifetime durability | Filming on developing roller |
|---|---|---|---|---|---|
| Example 1 | ○ | ○ | ◎ | ◎ | ◎ |
| Example 2 | ◎ | ◎ | ◎ | ◎ | ◎ |
| Example 3 | ◎ | ◎ | ○ | ○ | ◎ |
| Example 4 | ○ | ○ | ◎ | ○ | ◎ |
| Example 5 | ○ | ◎ | ○ | ◎ | ◎ |
| Example 6 | ◎ | ○ | ○ | ○ | ◎ |
| Example 7 | ○ | ○ | ◎ | ◎ | ◎ |
| Comparative Example 1 | ◎ | ◎ | X | Δ | Δ |
| Comparative Example 2 | X | X | ◎ | ◎ | ○ |
| Comparative Example 3 | ○ | ○ | X | X | ○ |
| Comparative Example 4 | Δ | Δ | ○ | ○ | X |
| Comparative Example 5 | Δ | Δ | ○ | X | ○ |
| Comparative Example 6 | ○ | Δ | X | ○ | Δ |

Referring to Table 3, the toners $T_1$ of Examples 1 to 7 were found to satisfy all of condition 1 (having an XRD intensity of larger than about 0.4 CPS to less than about 4 CPS at an angle 2θ of about 25.3°), condition 2 (having an XRD intensity of larger than about 34 CPS to less than about 344 CPS at an angle 2θ of about 27.4°), and condition 3 (having an XRD intensity of larger than about 92 CPS to less than about 1834 CPS at an angle 2θ of about) 32.3°, and thus to be good (○) or very good (◎) in terms of every evaluated characteristic.

The toner of Comparative Example 1 had an XRD intensity of about 4 at an angle 2θ of 25.3°, failing to satisfy condition 1 (having an XRD intensity of larger than about 0.4 CPS to less than about 4 CPS at an angle 2θ of about 25.3°). Accordingly, the toner of Comparative Example 1 was found to be very poor (x) in terms of photoreceptor background contamination, and poor (Δ) in terms of lifetime durability and filming on developing roller.

The toner of Comparative Example 2 had an XRD intensity of about 0.4 at an angle 2θ of 25.3°, failing to satisfy condition 1 (having an XRD intensity of larger than about 0.4 CPS to less than about 4 CPS at an angle 2θ of about 25.3°). Accordingly, the toner of Comparative Example 2 was very poor (x) in terms of image contamination from charge-up, and development/transfer characteristics.

The toner of Comparative Example 3 had an XRD intensity of about 344 at an angle 2θ of 27.4°, failing to satisfy condition 2 (having an XRD intensity of larger than about 34 CPS to less than about 344 CPS at an angle 2θ of about 27.4°). Accordingly, the toner of Comparative Example 3 was very poor (x) in terms of photoreceptor background contamination and lifetime durability.

The toner of Comparative Example 4 had an XRD intensity of about 34 at an angle 2θ of 27.4°, failing to satisfy condition 2 (having an XRD intensity of larger than about 34 CPS to less than about 344 CPS at an angle 2θ of about 27.4°). Accordingly, the toner of Comparative Example 4 was poor (Δ) in terms of image contamination from charge-up, and development/transfer characteristics, and very poor (x) in terms of filming on developing roller.

The toner of Comparative Example 5 had an XRD intensity of about 1834 at an angle 2θ of 32.3°, failing to satisfy condition 3 (having an XRD intensity of larger than about 92 CPS to less than about 1834 CPS at an angle 2θ of about 32.3°). Accordingly, the toner of Comparative Example 5 was poor (Δ) in terms of image contamination from charge-up, and development/transfer characteristics, and very poor (x) in terms of lifetime durability.

The toner of Comparative Example 6 had an XRD intensity of about 91.7 at an angle 2θ of 32.3°, failing to satisfy condition 3 (having an XRD intensity of larger than about 92 CPS to less than about 1834 CPS at an angle 2θ of about 32.3°). Accordingly, the toner of Comparative Example 6 was poor (Δ) in terms of development/transfer characteristics and filming on developing roller, and very poor (x) in terms of photoreceptor background contamination.

In summary, the toners $T_1$ of Examples 1 to 7, each including external additives to satisfy the conditions 1, 2, and 3 defined above, were found to have improved performance in all of the evaluated characteristics, i.e., in terms of charge-up characteristics, development/transfer characteristics, photoreceptor background contamination, lifetime durability, and filming on developing roller.

As described above, according to the one or more embodiments of the present inventive concept, a toner to develop an electrostatic latent image may have reduced charge-up characteristics, improved development characteristics, and improved transfer characteristics. The toner may ensure enhanced charge stability against environmental condition changes, and an appropriate amount of charges at a high printing speed, may reduce background contamination on a photoreceptor, may prevent undesirable fusing onto a blade even after prolonged printing, and may have high transfer efficiency and improved image uniformity. The toner may have effective flowability and transportability, and may have good storage stability, so as to be unlikely to cause blocking when stored for a long time.

The core particle of toner $T_1$ may include an agglomerated core toner particle of a first aggregated particle from a first binder resin latex mixture of about 95 wt % of a low molecular weight binder resin latex having a weight average molecular weight of about 25,000 g/mol and a glass transition temperature of about 62° C. and about 5 wt % of a high molecular weight binder resin latex having a weight average molecular weight of about 250,000 g/mol and a glass transition temperature of about 53° C. The first aggregated particle has a particle size of from about 1.5 μm to about 2.5 μm. The first aggregated particle is combined with a second binder resin latex mixture of about 90 wt % of the low molecular weight binder resin latex having the weight average molecular weight of about 25,000 g/mol and the glass transition temperature of about 62° C. and about 10 wt % of the high molecular weight binder resin latex having the weight average molecular weight of about 250,000 g/mol and the glass transition temperature of about 53° C., so that the core particle has a potato shape with a size of about 6.5 μm to about 7.0 μm.

Exemplary embodiments of the present general inventive concept may provide a toner $T_1$ to develop an electrostatic latent image, the toner $T_1$ may have a core particle that includes a binder resin, a colorant, and a releasing agent, and an external additive adhering to an external surface of the core particle. The external additive may include an amount of sol-gel silica that is about 2 parts by weight relative to 100 parts by weight of the core particle, an amount of rutile titanium oxide that is from about 0.25 parts by weight to about 0.75 parts by weight relative to 100 parts by weight of the core particle, an amount of anatase titanium oxide that is from about 0.25 parts by weight to about 0.75 parts by weight relative to 100 parts by weight of the core particle, and an amount of strontium titanium oxide that is from about 0.25 parts by weight to about 0.75 parts by weight relative to 100 parts by weight of the core particle. Intensities of silicon and iron in the toner $T_1$, as measured by X-ray fluorescence spectrometry (XRF), satisfy the following condition: $0.004 \leq [Si]/[Fe] \leq 0.009$, wherein [Si] denotes the intensity of silicon and [Fe] denotes the intensity of iron.

The toner $T_1$ may satisfy Conditions 1, 2, and 3 below, where 2θ is an angle of an x-ray diffraction detector and CPS is a number of counts per second of X-rays measured by the detector at the angle of 2θ: Condition 1: an X-ray diffraction (XRD) intensity of the toner $T_1$ at an angle 2θ of 25.3° is larger than about 0.4 CPS to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

Figure 7:
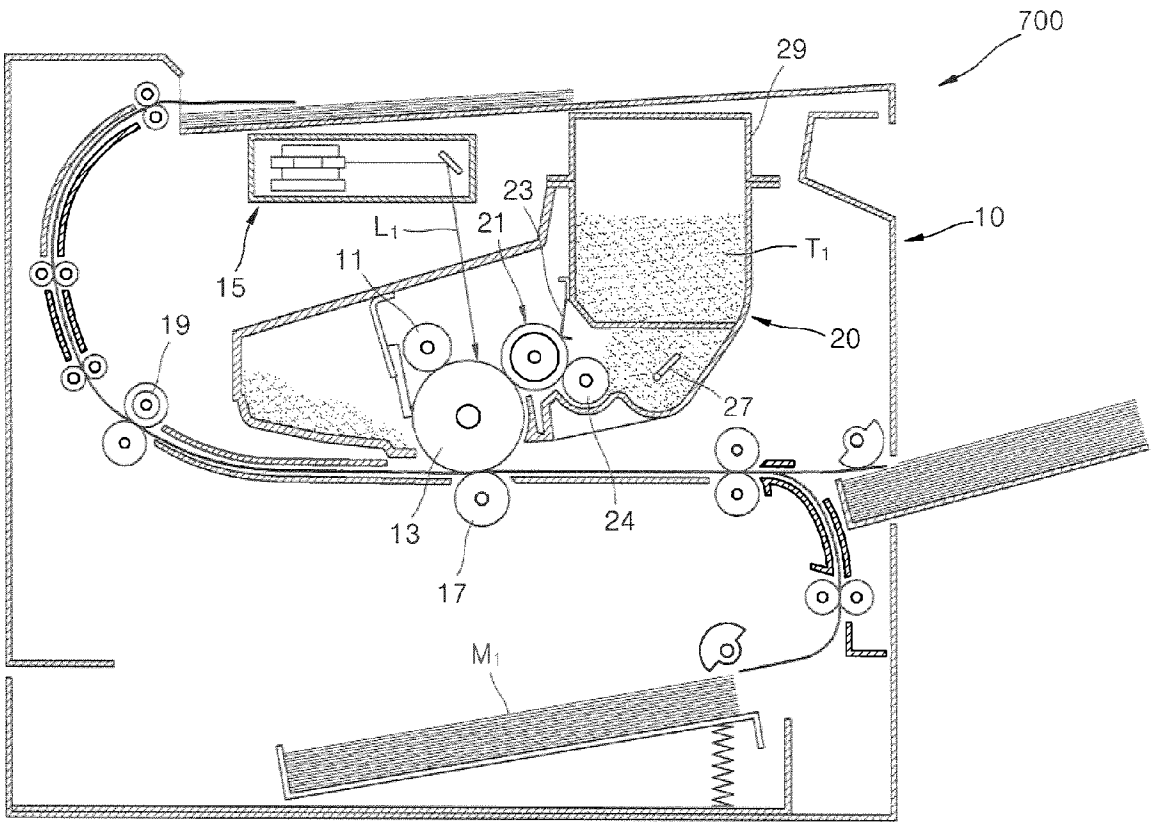
FIG. 7 illustrates an image forming apparatus having a toner cartridge/device to supply toner $T_1$ to develop an electrostatic charge image in accordance with embodiments of the present general inventive concept.

As illustrated in FIG. 7, an electrophotographic charge image forming apparatus 700 may include a cabinet 10, a charging unit 11 provided inside the cabinet 10, a photosensitive medium (electrostatic charge forming member) 13, a light scanning unit 15, a developing (toner) cartridge 20, a transferring roller 17 and a fusing (fixing) roller 19.

The photosensitive medium 13 is disposed inside the developing cartridge/device 20. The photosensitive medium 13 is charged to have a predetermined electric potential by the charging unit 11, and responds to a light $L_1$ scanned from the light scanning unit 15 to form an electrostatic latent image corresponding to an image to be printed.

The developing (toner) cartridge/device 20 accommodates a developer/toner $T_1$ in a developer accommodating part 29, and supplies the toner $T_1$ to the photosensitive medium 13 through an agitator 27, a supplying roller 24 and a developing device (roller) 21 to form the image. Here, a regulating blade 23 is applied to an outer surface of the developing roller 21 to regulate the amount of the supplied toner $T_1$. The toner $T_1$ transported through the developing roller 21 passes between the regulating blade 23 and the developing roller 21 to form a toner layer having a predetermined thickness on the developing roller 21. The image formed on the photosensitive medium 13 is transferred to a print medium $M_1$, transported between the photosensitive medium 13 and the transferring roller 17, and is fused to the print medium $M_1$ by the fusing (fixing) roller 19.

Exemplary embodiments of the present general inventive concept may provide a process cartridge 20 that includes an electrostatic charge image bearing member 13 configured to bear an electrostatic charge image and a developing device 21 configured to develop the electrostatic charge image with a toner $T_1$ that develops an electrostatic charge image. The toner $T_1$ includes a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

Exemplary embodiments of the present general inventive concept may provide a toner device/cartridge 20 that includes a container (developer accommodating part) 29 to supply the toner $T_1$. The toner $T_1$ includes a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

The toner $T_1$ may include the amount of sol-gel silica that is about 2 parts by weight relative to 100 parts by weight of the core particle, the amount of rutile titanium oxide that is about 0.5 parts by weight relative to 100 parts by weight of the core particle, the amount of anatase titanium oxide that is about 0.5 parts by weight relative to 100 parts by weight of the core particle, and the amount of strontium titanium oxide that is about 0.5 parts by weight relative to 100 parts by weight of the core particle.

Exemplary embodiments of the present general inventive concept may provide an image forming apparatus 700 that includes an electrostatic charge image forming member 13 configured to bear an electrostatic charge image, an electrostatic charge image forming device 11 configured to form an electrostatic charge image on the electrostatic charge image bearing member 13, a developing device 21 configured to develop the electrostatic charge image with a toner $T_1$ that develops an electrostatic charge image, to form a toner image, a transfer device/roller 17 configured to transfer the toner image onto a recording medium, and a fixing device/roller 19 configured to fix the toner image on the recording medium $M_1$. The toner $T_1$ includes a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS.

Figure 8:
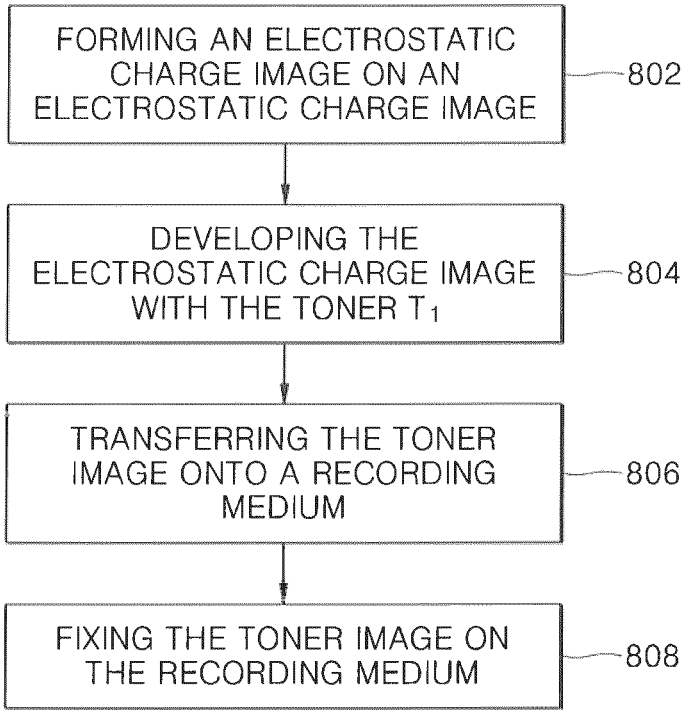
FIG. 8 illustrates a flow chart of a method of forming an image in an image forming apparatus in accordance with an embodiment of the present general inventive concept.

As illustrated in FIG. 8, exemplary embodiments of the present general inventive concept may also provide an image forming method that includes the operations of forming an electrostatic charge image on an electrostatic charge image bearing member 802, developing the electrostatic charge image with the toner $T_1$, the toner $T_1$ including a core particle that includes a binder resin, a colorant, a releasing agent, and an external additive adhering to an external surface of the core particle, the external additive including a silica particle, an anatase titanium dioxide particle, a rutile titanium dioxide particle, and a strontium titanium oxide particle, wherein the toner $T_1$ satisfies Conditions 1, 2, and 3: Condition 1: an X-ray diffraction (XRD) intensity of the toner $T_1$ at an angle 2θ (where 2θ is an angle of an x-ray diffraction detector) of 25.3° is larger than about 0.4 counts per second of X-rays measured by the detector at the angle of 2θ (CPS) to less than about 4 CPS, Condition 2: an XRD intensity of the toner $T_1$ at an angle 2θ of 27.4° is larger than about 34 CPS to less than about 344 CPS, and Condition 3: an XRD intensity of the toner $T_1$ at an angle 2θ of 32.3° is larger than about 92 CPS to less than about 1834 CPS, to form a toner image 804, transferring the toner image onto a recording medium 806, and fixing the toner image on the recording medium 808.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner T1 to develop an electrostatic latent image, the toner T1 comprising:

a core particle comprising a binder resin, a colorant, and a releasing agent, and an external additive adhering to an external surface of the core particle, the external additive comprising a silica particle, an anatase titanium dioxide particle, a rutile titanium dioxide particle, and a strontium titanium oxide particle, wherein the core particle comprises an agglomerated core toner particle of a first aggregated particle from a first binder resin latex mixture of approximately 95 wt % of a low molecular weight binder resin latex having a weight average molecular weight of approximately 25,000 g/mol and a glass transition temperature of approximately 62° C., and approximately 5 wt % of a high molecular weight binder resin latex having a weight average molecular weight of approximately 250,000 g/mol and a glass transition temperature of approximately 53° C., the first aggregated particle having a particle size of from approximately 1.5 μm to approximately 2.5 μm, the first aggregated particle being combined with a second binder resin latex mixture of approximately 90 wt % of the low molecular weight binder resin latex having the weight average molecular weight of approximately 25,000 g/mol and the glass transition temperature of approximately 62° C., and approximately 10 wt % of the high molecular weight binder resin latex having the weight average molecular weight of approximately 250,000 g/mol and the glass transition temperature of approximately 53° C., so that the core particle has a potato shape with a size of approximately 6.5 urn to approximately 7.0 μm.

2. The toner T1 of claim 1, wherein the toner T1 has a dielectric loss factor of about 0.01 to about 0.03.

3. The toner T1 of claim 1, wherein the toner T1 has a degree of hydrophobicity of about 30 to about 60.

4. A toner T1 to develop an electrostatic latent image, the toner T1 comprising:

a core particle comprising a binder resin, a colorant, and a releasing agent, and an external additive adhering to an external surface of the core particle, the external additive comprising:

an amount of sol-gel silica that is about 2 parts by weight relative to 100 parts by weight of the core particle;

an amount of rutile titanium oxide that is from about 0.25 parts by weight to about 0.75 parts by weight relative to 100 parts by weight of the core particle;

an amount of anatase titanium oxide that is from about 0.25 parts by weight to about 0.75 parts by weight relative to 100 parts by weight of the core particle; and an amount of strontium titanium oxide that is from about 0.25 parts by weight to about 0.75 parts by weight relative to 100 parts by weight of the core particle, wherein the core particle comprises an agglomerated core toner particle of a first aggregated particle from a first binder resin latex mixture of approximately 95 wt % of a low molecular weight binder resin latex having a weight average molecular weight of approximately 25,000 g/mol and a glass transition temperature of approximately 62° C., and approximately 5 wt of a high molecular weight binder resin latex having a weight average molecular weight of approximately 250,000 g/mol and a glass transition temperature of approximately 53° C., the first aggregated particle having a particle size of from approximately 1.5 μm to approximately 2.5 Lam, the first aggregated particle being combined with a second binder resin latex mixture of approximately 90 wt % of the low molecular weight binder resin latex having the weight average molecular weight of approximately 25,000 g/mol and the glass transition temperature of approximately 62° C., and approximately 10 wt % of the high molecular weight binder resin latex having the weight average molecular weight of approximately 250,000 g/mol and the glass transition temperature of approximately 53° C., so that the core particle has a potato shape with a size of approximately 6.5 μm to approximately 7.0 μm.

5. The toner T1 of claim 4, wherein the amount of sol-gel silica is about 2 parts by weight relative to 100 parts by weight of the core particle, the amount of rutile titanium oxide is about 0.5 parts by weight relative to 100 parts by weight of the core particle, the amount of anatase titanium oxide is about 0.5 parts by weight relative to 100 parts by weight of the core particle, and the amount of strontium titanium oxide is about 0.5 parts by weight relative to 100 parts by weight of the core particle.

6. A process cartridge comprising:

an electrostatic latent image bearing member configured to bear an electrostatic latent image; and a developing device configured to develop the electrostatic latent image with a toner T1 to form a toner image, the toner T1 having a core particle comprising a binder resin, a colorant, and a releasing agent, and an external additive adhering to an external surface of the core particle, the external additive comprising a silica particle, an anatase titanium dioxide particle, a rutile titanium dioxide particle, and a strontium titanium oxide particle, wherein the core particle comprises an agglomerated core toner particle of a first aggregated particle from a first binder resin latex mixture of approximately 95 wt % of a low molecular weight binder resin latex having a weight average molecular weight of approximately 25,000 g/mol and a glass transition temperature of approximately 62° C., and approximately 5 wt % of a high molecular weight binder resin latex having a weight average molecular weight of approximately 250,000 g/mol and a glass transition temperature of approximately 53° C., the first aggregated particle having a particle size of from approximately 1.5 μm to approximately 2.5 μm, the first aggregated particle being combined with a second binder resin latex mixture of approximately 90 wt % of the low molecular weight binder resin latex having the weight average molecular weight of approximately 25,000 g/mol and the glass transition temperature of approximately 62° C., and approximately 10 wt % of the high molecular weight binder resin latex having the weight average molecular weight of approximately 250,000 g/mol and the glass transition temperature of approximately 53° C., so that the core particle has a potato shape with a size of approximately 6.5 μm to approximately 7.0 μm.

7. A toner container, comprising a container having therein a toner T1, the toner T1 having a core particle comprising a binder resin, a colorant, and a releasing agent, and an external additive adhering to an external surface of the core particle, the external additive comprising a silica particle, an anatase titanium dioxide particle, a rutile titanium dioxide particle, and a strontium titanium oxide particle, wherein the core particle comprises an agglomerated core toner particle of a first aggregated particle from a first binder resin latex mixture of approximately 95 wt % of a low molecular weight binder resin latex having a weight average molecular weight of approximately 25,000 g/mol and a glass transition temperature of approximately 62° C., and approximately 5 wt % of a high molecular weight binder resin latex having a weight average molecular weight of approximately 250,000 g/mol and a glass transition temperature of approximately 53° C., the first aggregated particle having a particle size of from approximately 1.5 μm to approximately 2.5 μm, the first aggregated particle being combined with a second binder resin latex mixture of approximately 90 wt % of the low molecular weight binder resin latex having the weight average molecular weight of approximately 25,000 g/mol and the glass transition temperature of approximately 62° C., and approximately 10 wt % of the high molecular weight binder resin latex having the weight average molecular weight of approximately 250,000 g/mol and the glass transition temperature of approximately 53° C., so that the core particle has a potato shape with a size of approximately 6.5 μm to approximately 7.0 μm.

8. An image forming apparatus, comprising:

an electrostatic latent image bearing member configured to bear an electrostatic latent image;

an electrostatic latent image forming device configured to form an electrostatic latent image on the electrostatic latent image bearing member;

a developing device configured to develop the electrostatic latent image with a toner T1 to form a toner image, the toner T1 having a core particle comprising a binder resin, a colorant, and a releasing agent, and an external additive adhering to an external surface of the core particle, the external additive comprising a silica particle, an anatase titanium dioxide particle, a rutile titanium dioxide particle, and a strontium titanium oxide particle, a transfer device configured to transfer the toner image onto a recording medium; and a fixing device configured to fix the toner image on the recording medium, wherein the core particle comprises an agglomerated core toner particle of a first aggregated particle from a first binder resin latex mixture of approximately 95 wt % of a low molecular weight binder resin latex having a weight average molecular weight of approximately 25,000 g/mol and a glass transition temperature of approximately 62° C., and approximately 5 wt % of a high molecular weight binder resin latex having a weight average molecular weight of approximately 250,000 g/mol and a glass transition temperature of approximately 53° C., the first aggregated particle having a particle size of from approximately 1.5 μm to approximately 2.5 μm, the first aggregated particle being combined with a second binder resin latex mixture of approximately 90 wt % of the low molecular weight binder resin latex having the weight average molecular weight of approximately 25,000 g/mol and the glass transition temperature of approximately 62° C., and approximately 10 wt % of the high molecular weight binder resin latex having the weight average molecular weight of approximately 250,000 g/mol and the glass transition temperature of approximately 53° C., so that the core particle has a potato shape with a size of approximately 6.5 μm to approximately 7.0 μm.

9. An image forming method, comprising:

forming an electrostatic latent image on an electrostatic latent image bearing member;

developing the electrostatic latent image with a toner T1 to form a toner image, the toner T1 having a core particle comprising a binder resin, a colorant, and a releasing agent, and an external additive adhering to an external surface of the core particle, the external additive comprising a silica particle, an anatase titanium dioxide particle, a rutile titanium dioxide particle, and a strontium titanium oxide particle;

transferring the toner image onto a recording medium; and fixing the toner image on the recording medium, wherein the core particle comprises an agglomerated core toner particle of a first aggregated particle from a first binder resin latex mixture of approximately 95 wt % of a low molecular weight binder resin latex having a weight average molecular weight of approximately 25,000 g/mol and a glass transition temperature of approximately 62° C., and approximately 5 wt % of a high molecular weight binder resin latex having a weight average molecular weight of approximately 250,000 g/mol and a glass transition temperature of approximately 53° C., the first aggregated particle having a particle size of from approximately 1.5 μm to approximately 2.5 μm, the first aggregated particle being combined with a second binder resin latex mixture of approximately 90 wt % of the low molecular weight binder resin latex having the weight average molecular weight of approximately 25,000 g/mol and the glass transition temperature of approximately 62° C., and approximately 10 wt % of the high molecular weight binder resin latex having the weight average molecular weight of approximately 250,000 g/mol and the glass transition temperature of approximately 53° C., so that the core particle has a potato shape with a size of approximately 6.5 μm to approximately 7.0 μm.

10. The toner T1 of claim 1, wherein the toner T1 satisfies Conditions 1, 2, and 3 below, where 2θ is an angle of an x-ray diffraction detector and CPS is a number of counts per second of X-rays measured by the detector at the angle of 2θ:

Condition 1: an X-ray diffraction (XRD) intensity of the toner T1 at an angle 2θ of 25.3° is larger than about 0.4 CPS to less than about 4 CPS;

Condition 2: an XRD intensity of the toner T1 at an angle 2θ of 27.4° is larger than about 34 CPS to less than about 344 CPS; and Condition 3: an XRD intensity of the toner T1 at an angle 2θ of 32.3° is larger than about 92 CPS to less than about 1834 CPS.

11. The toner T1 of claim 1, wherein the toner T1 further comprises iron, and wherein intensities of silicon and iron in the toner T1, as measured by X-ray fluorescence spectrometry (XRF), satisfy the following condition:

$$0.004 \leq [Si]/[Fe] \leq 0.009,$$

wherein [Si] denotes the intensity of silicon and [Fe] denotes the intensity of iron.

12. The toner T1 of claim 4, wherein the toner T1 satisfies Conditions 1, 2, and 3 below, where 2θ is an angle of an x-ray diffraction detector and CPS is a number of counts per second of X-rays measured by the detector at the angle of 2θ:

Condition 1: an X-ray diffraction (XRD) intensity of the toner T1 at an angle 2θ of 25.3° is larger than about 0.4 CPS to less than about 4 CPS;

Condition 2: an XRD intensity of the toner T1 at an angle 2θ of 27.4° is larger than about 34 CPS to less than about 344 CPS; and Condition 3: an XRD intensity of the toner T1 at an angle 2θ of 32.3° is larger than about 92 CPS to less than about 1834 CPS.

13. The toner T1 of claim 4, wherein the toner T1 further comprises iron, and wherein intensities of silicon and iron in the toner T1, as measured by X-ray fluorescence spectrometry (XRF), satisfy the following condition:

$$0.004 \leq [Si]/[Fe] \leq 0.009,$$

wherein [Si] denotes the intensity of silicon and [Fe] denotes the intensity of iron.

14. The process cartridge of claim 6, wherein the toner T1 satisfies Conditions 1, 2, and 3 below, where 2θ is an angle of an x-ray diffraction detector and CPS is a number of counts per second of X-rays measured by the detector at the angle of 2θ:

Condition 1: an X-ray diffraction (XRD) intensity of the toner T1 at an angle 2θ of 25.3° is larger than about 0.4 CPS to less than about 4 CPS;

Condition 2: an XRD intensity of the toner T1 at an angle 2θ of 27.4° is larger than about 34 CPS to less than about 344 CPS; and Condition 3: an XRD intensity of the toner T1 at an angle 2θ of 32.3° is larger than about 92 CPS to less than about 1834 CPS.

15. The process cartridge of claim 6, wherein the toner T1 further comprises iron, and wherein intensities of silicon and iron in the toner T1, as measured by X-ray fluorescence spectrometry (XRF), satisfy the following condition:

$$0.004 \leq [Si]/[Fe] \leq 0.009,$$

wherein [Si] denotes the intensity of silicon and [Fe] denotes the intensity of iron.

16. The toner container of claim 7, wherein the toner T1 satisfies Conditions 1, 2, and 3 below, where 2θ is an angle of an x-ray diffraction detector and CPS is a number of counts per second of X-rays measured by the detector at the angle of 2θ:

Condition 1: an X-ray diffraction (XRD) intensity of the toner T1 at an angle 2θ of 25.3° is larger than about 0.4 CPS to less than about 4 CPS;

Condition 2: an XRD intensity of the toner T1 at an angle 2θ of 27.4° is larger than about 34 CPS to less than about 344 CPS; and Condition 3: an XRD intensity of the toner T1 at an angle 2θ of 32.3° is larger than about 92 CPS to less than about 1834 CPS.

17. The toner container of claim 7, wherein the toner T1 further comprises iron, and wherein intensities of silicon and iron in the toner T1, as measured by X-ray fluorescence spectrometry (XRF), satisfy the following condition:

$$0.004 \leq [Si]/[Fe] \leq 0.009,$$

wherein [Si] denotes the intensity of silicon and [Fe] denotes the intensity of iron.

18. The image forming apparatus of claim 8, wherein the toner T1 satisfies Conditions 1, 2, and 3 below, where 2θ is an angle of an x-ray diffraction detector and CPS is a number of counts per second of X-rays measured by the detector at the angle of 2θ:

Condition 1: an X-ray diffraction (XRD) intensity of the toner T1 at an angle 2θ of 25.3° is larger than about 0.4 CPS to less than about 4 CPS;

Condition 2: an XRD intensity of the toner T1 at an angle 2θ of 27.4° is larger than about 34 CPS to less than about 344 CPS; and Condition 3: an XRD intensity of the toner T1 at an angle 2θ of 32.3° is larger than about 92 CPS to less than about 1834 CPS.

19. The image forming apparatus of claim 8, wherein the toner T1 further comprises iron, and wherein intensities of silicon and iron in the toner T1, as measured by X-ray fluorescence spectrometry (XRF), satisfy the following condition:

$$0.004 \leq [Si]/[Fe] \leq 0.009,$$

wherein [Si] denotes the intensity of silicon and [Fe] denotes the intensity of iron.

20. The image forming method of claim 9, wherein the toner T1 satisfies Conditions 1, 2, and 3 below, where 2θ is an angle of an x-ray diffraction detector and CPS is a number of counts per second of X-rays measured by the detector at the angle of 2θ:

Condition 1: an X-ray diffraction (XRD) intensity of the toner T1 at an angle 2θ of 25.3° is larger than about 0.4 CPS to less than about 4 CPS;

Condition 2: an XRD intensity of the toner T1 at an angle 2θ of 27.4° is larger than about 34 CPS to less than about 344 CPS; and Condition 3: an XRD intensity of the toner T1 at an angle 2θ of 32.3° is larger than about 92 CPS to less than about 1834 CPS.

21. The image forming method of claim 9, wherein the toner T1 further comprises iron, and wherein intensities of silicon and iron in the toner T1, as measured by X-ray fluorescence spectrometry (XRF), satisfy the following condition:

$$0.004 \leq [Si]/[Fe] \leq 0.009,$$

wherein [Si] denotes the intensity of silicon and [Fe] denotes the intensity of iron.

* * * * *